US010729968B2

(12) United States Patent
Barden et al.

(10) Patent No.: US 10,729,968 B2
(45) Date of Patent: Aug. 4, 2020

(54) REMOTE RELEASE SNOWBOARD BINDING

(71) Applicant: Rossland Binding Company, Red Deer (CA)

(72) Inventors: Rob C. Barden, Red Deer (CA); Jeffrey Wayne Herr, Rossland (CA)

(73) Assignee: Rossland Binding Company, Red Deer (CA)

( * ) Notice: Subject to any disclaimer, the term of this patent is extended or adjusted under 35 U.S.C. 154(b) by 182 days.

(21) Appl. No.: 15/990,161

(22) Filed: May 25, 2018

(65) Prior Publication Data

US 2019/0358516 A1 Nov. 28, 2019

(51) Int. Cl.
*A63C 10/02* (2012.01)

(52) U.S. Cl.
CPC ..... *A63C 10/02* (2013.01)

(58) Field of Classification Search
CPC ..... A63C 10/02; A63C 9/0802; A63C 9/088; A63C 9/0885
See application file for complete search history.

(56) References Cited

U.S. PATENT DOCUMENTS

| | | | | |
|---|---|---|---|---|
| 2,854,242 | A | 9/1958 | Pratt | |
| 3,596,374 | A | 8/1971 | Covington | |
| 3,635,485 | A | 1/1972 | Gertsch et al. | |
| 3,764,154 | A | 10/1973 | Witting | |
| 3,787,868 | A | 1/1974 | Camp | |
| 3,794,339 | A | 2/1974 | Smolka | |
| 3,819,199 | A | 6/1974 | Smolka et al. | |
| 3,860,253 | A | 1/1975 | Schweizer | |
| 3,861,698 | A | 1/1975 | Greig | |
| 3,873,111 | A | 3/1975 | Imagawa | |
| 3,892,422 | A | 7/1975 | Jasques et al. | |
| 3,895,817 | A | 7/1975 | Gertsch et al. | |
| 3,909,025 | A | 9/1975 | Gertsch et al. | |
| 3,909,028 | A | 9/1975 | Courvoisier et al. | |
| 3,947,051 | A * | 3/1976 | Sittmann ..... | A43B 1/0054 280/611 |

(Continued)

FOREIGN PATENT DOCUMENTS

| | | |
|---|---|---|
| DE | 2309888 | 8/1974 |
| DE | 102007001599 | 7/2007 |

(Continued)

OTHER PUBLICATIONS

Bon Hiver Freebase Binding System, available at least as early as Feb. 25, 2019 at http://bonhiver.com/product/ , 3 pages.

(Continued)

*Primary Examiner* — Bryan A Evans
(74) *Attorney, Agent, or Firm* — Workman Nydegger

(57) ABSTRACT

In one example, a snowboard binding includes a retention and release assembly configured to be mounted to a snowboard, and further includes a retention mechanism operable by a wireless remote control. A boot interface portion of the snowboard binding is configured to releasably engage the retention and release assembly, and the boot interface portion is also configured to releasably retain a boot. In operation, the user can enable release of the boot interface portion from the retention mechanism by activating the wireless remoted control so as to cause the boot interface portion to be unlocked from the retention mechanism.

26 Claims, 38 Drawing Sheets

(56) References Cited

U.S. PATENT DOCUMENTS

| | | | | |
|---|---|---|---|---|
| 3,950,000 | A | 4/1976 | Sittmann | |
| 3,977,688 | A | 8/1976 | Imagawa | |
| 4,077,653 | A | 3/1978 | Beyl | |
| 4,098,010 | A | 7/1978 | Rothmayer | |
| 4,121,854 | A | 10/1978 | Cornu | |
| 4,160,555 | A | 7/1979 | Salomon | |
| 4,251,090 | A | 2/1981 | Weigl | |
| 4,264,087 | A | 4/1981 | Bortoli | |
| 4,291,894 | A | 9/1981 | D'Antonio | |
| 4,294,460 | A | 10/1981 | Kirsch | |
| 4,436,321 | A | 3/1984 | Storandt | |
| 4,444,411 | A | 4/1984 | Svoboda | |
| 4,548,424 | A | 10/1985 | Spitaler | |
| 4,563,021 | A | 1/1986 | Klubitschko | |
| 4,776,608 | A | 10/1988 | Caillat | |
| 4,854,605 | A | 8/1989 | Emerson | |
| 4,934,669 | A | 6/1990 | Bourdeau et al. | |
| 5,035,443 | A * | 7/1991 | Kincheloe | A63C 10/02 280/14.22 |
| 5,082,410 | A | 1/1992 | Provence | |
| 5,085,453 | A | 2/1992 | Bildner | |
| 5,106,118 | A | 4/1992 | Frey | |
| 5,129,668 | A | 7/1992 | Hecht | |
| 5,150,913 | A | 9/1992 | Hoelzl | |
| 5,167,424 | A | 12/1992 | Baggio et al. | |
| 5,213,356 | A | 5/1993 | Rohrmoser | |
| 5,253,894 | A | 10/1993 | Thomas et al. | |
| 5,295,704 | A | 3/1994 | Flock | |
| 5,297,812 | A | 3/1994 | Dogat et al. | |
| 5,299,823 | A | 4/1994 | Glaser | |
| 5,326,126 | A | 7/1994 | Ruffinengo | |
| 5,338,051 | A | 8/1994 | Szafranski et al. | |
| 5,344,178 | A | 9/1994 | Rohrmoser | |
| 5,411,283 | A | 5/1995 | Nowak | |
| 5,498,017 | A | 3/1996 | Rohrmoser | |
| 5,509,683 | A | 4/1996 | Daniel | |
| 5,564,719 | A * | 10/1996 | Kisselmann | A63C 5/03 280/14.23 |
| 5,566,966 | A | 10/1996 | Couderc et al. | |
| 5,575,496 | A | 11/1996 | Luitz et al. | |
| 5,611,559 | A | 3/1997 | Luitz et al. | |
| 5,636,856 | A | 6/1997 | Luitz et al. | |
| 5,735,541 | A | 4/1998 | Fritschi et al. | |
| 5,941,553 | A | 8/1999 | Korman | |
| 5,984,324 | A * | 11/1999 | Wariakois | A63C 5/02 280/14.24 |
| 6,007,085 | A | 12/1999 | Rigal et al. | |
| 6,007,086 | A | 12/1999 | Hopkins | |
| 6,050,591 | A | 4/2000 | Bardin et al. | |
| 6,056,310 | A | 5/2000 | Hangl | |
| 6,095,547 | A | 8/2000 | Vandergrift et al. | |
| 6,227,558 | B1 | 5/2001 | Arduin et al. | |
| 6,454,291 | B1 | 9/2002 | Hillairet et al. | |
| 6,471,235 | B1 | 10/2002 | Luitz et al. | |
| 6,513,826 | B1 | 2/2003 | Hangl | |
| 6,565,110 | B1 | 5/2003 | Holzer | |
| 6,623,026 | B2 | 9/2003 | Dogat et al. | |
| 6,641,162 | B2 | 11/2003 | Allmann et al. | |
| 6,659,494 | B1 | 12/2003 | Martin | |
| 6,705,633 | B2 | 3/2004 | Poscich | |
| 6,769,711 | B1 | 8/2004 | Martin et al. | |
| 6,840,531 | B2 | 1/2005 | Gorza et al. | |
| 7,004,494 | B2 | 2/2006 | Wulf | |
| 7,017,808 | B2 | 3/2006 | Holzer | |
| 7,073,812 | B2 | 7/2006 | Rigal | |
| 7,104,564 | B2 | 9/2006 | Martin et al. | |
| 7,523,953 | B2 | 4/2009 | Ettlinger | |
| 7,762,573 | B2 * | 7/2010 | Zaloom | A63C 5/03 280/611 |
| 7,815,213 | B2 | 10/2010 | Damiani | |
| 7,841,614 | B2 | 11/2010 | Damiani | |
| 8,403,354 | B2 | 3/2013 | Senner | |
| 8,612,181 | B2 | 12/2013 | Czaja et al. | |
| 8,910,967 | B2 | 12/2014 | Bjertnaes et al. | |
| 9,526,971 | B1 | 12/2016 | Barden | |
| 2005/0194764 | A1 | 9/2005 | Bluemel | |
| 2007/0090627 | A1 | 4/2007 | Laurent | |
| 2007/0170695 | A1 | 7/2007 | Damiani | |
| 2007/0170696 | A1 | 7/2007 | Damiani | |
| 2009/0212534 | A1 | 8/2009 | Mercat | |
| 2009/0224526 | A1 * | 9/2009 | Bildner | A43B 1/0054 280/816 |
| 2009/0243259 | A1 | 10/2009 | De La Torre Rodriguez | |

FOREIGN PATENT DOCUMENTS

| | | |
|---|---|---|
| DE | 102011100933 | 11/2012 |
| FR | 2823985 | 10/2002 |
| FR | 2853254 | 10/2004 |
| KR | 101753612 | 7/2017 |
| WO | WO95122440 | 5/1995 |
| WO | WO0213924 | 2/2002 |

OTHER PUBLICATIONS

Mountainyahoos, Bon Hiver "Freebase" Snowboard Bindings, available at YouTube at https://www.youtube.com/watch?v=nOPrhA3BYpU , Published on Feb. 7, 2012, 2 pages.

Clew GMBH, The clever and new step-in snowboard binding, available at least as early as Feb. 25, 2019 at https://www.clew.de/ , 4 pages.

U.S. Appl. No. 14/857,989, filed Sep. 18, 2015, Barden, et al.

U.S. Appl. No. 15/342,502, filed Nov. 3, 2016, Barden, et al.

International Search Report and Written Opinion of PCT/CA2016/051081 dated Nov. 28, 2016.

Canadian Office Action of Application Serial No. 2,993,240 dated Mar. 5, 2018.

U.S. Appl. No. 14/857,989, Jul. 27, 2016, Office Action.

U.S. Appl. No. 14/857,989, Sep. 15, 2016, Notice of Allowance.

International Search Report and Written Opinion for PCT/IB2019/053956 dated Sep. 18, 2019.

* cited by examiner

③ AFTER ROTATION, BINDING SLIDES OFF THE RETENTION ASSEMBLY AND IS FREE

4 TO REINSTALL BINDING, USER SLIDES BINDING ONTO RETENTION ASSEMBLY

5 AFTER SLIDING BINDING ON ALL THE WAY, USER ROTATES FOOT TO RIDING POSITION

⑥ BINDING *CLICKS* WHEN IT REACHES HOME AND IS READY TO RIDE

REMOTE RELEASE SNOWBOARD BINDING

FIELD OF THE INVENTION

The present disclosure is generally concerned with sporting equipment and, in particular, with a remote release snowboard binding and associated controls.

BACKGROUND

A number of advances have been made over the years to improve the safety and functionality of snowboard bindings. However, those bindings still suffer from some shortcomings both in terms of their safety and convenience of use.

For example, circumstances sometimes occur in which a rider is involved in an incident such as a crash that, while not harmful in itself, may nonetheless place the rider in danger. By way of illustration, a rider may get stuck in a tree well simply by riding too close to a tree. Although there may have been no crash, or only a minor crash, and possibly only a minor fall involved, it is well known that tree wells can be dangerous and, as such, the rider who falls into one may be in a potentially life threatening situation.

A significant part of the danger posed by tree wells is that it can be quite difficult for the rider to extricate himself, and riders have been known to suffocate, or die of hypothermia, in the attempt. Escape from a tree well may be complicated significantly by the fact that the boots of the rider are still attached to his snowboard. This is because conventional snowboard bindings are fixed to the snowboard, such as by way of fasteners, and the rider can only get out of the bindings by releasing the buckles that hold the boot of the rider in the binding. Such snowboard bindings are not designed, or intended, to automatically release the rider from the snowboard. As well, it is not uncommon for a rider to end up in a head-down orientation in a tree well. When the rider is positioned in this way, it may be difficult, or impossible, for the rider to reach and release the binding.

Moreover, the rider may be in an awkward position that makes it difficult or impossible to reach the bindings and unbuckle them. Thus, in this scenario, the snowboard binding may impair, or even prevent, the rider from escaping his predicament. This could be particularly problematic, for example, in a backcountry scenario where there may be few other people nearby who could readily lend assistance to the trapped rider.

As a further illustrative example of some shortcomings of conventional snowboard bindings, it is not uncommon for novice riders, in particular, to get their snowboard caught on a chair, rope, tow, tram, gondola, or other equipment when the rider is loading or unloading. Because the lift typically cannot stop immediately, the rider may find himself being dragged, pulled, or flipped by his snowboard for some distance. In some cases, the forces involved may be significant enough to cause injury to the rider.

Other shortcomings of typical snowboard bindings may be more a matter of convenience than safety. For example, when novice riders, particularly younger riders, crash or fall, they are still connected to their snowboard. It can be difficult for these riders to get back on their feet and begin riding again. This is particularly so if the rider should happen to fall in relatively deep snow.

Moreover, even if a rider is experienced, it is not uncommon for riders to be involved in crashes or falls. If such a crash or fall occurs in deep snow, for example, it can be quite difficult and time consuming for the rider to dig out and return to riding if the board is still attached to the boots of the rider, as is typically the case. Likewise, if a user is caught in an avalanche, it may be desirable to be able to release the snowboard as quickly as possible so as to increase the chances of the rider for survival.

In view of problems such as those noted, and others, what is needed is a snowboard binding configured to enable the rider to release himself from the snowboard at any time on his initiative. As well, the snowboard binding should be configured to release the user from the snowboard with little or no effort on the part of the user. For example, the user should not have to operate any of the buckles of the snowboard binding to be released from the snowboard. Moreover, the snowboard binding should enable the boot of the rider to remain buckled into a portion of the binding both during and after release of the rider from the snowboard. Finally, the snowboard binding should be compatible with contemporary snowboard designs so that it can be used without requiring significant modifications to the snowboard.

Aspects of Some Example Embodiments

The present disclosure is generally concerned with snow sport devices and associated bindings. One particular, but non-limiting, example of a snow sport device is a snowboard that includes snowboard bindings and, more particularly, snowboard bindings that can release a snowboard at any time upon the initiative of the user. That is, when the snowboard is released, the snowboard is no longer connected, either directly or indirectly, to the user. To illustrate, the user can pick up and carry the snowboard after the snowboard has been released. This release function of the snowboard binding can be effected remotely by a user and/or another.

A. Elements of Some Example Embodiments

More particularly, example embodiments within the scope of this disclosure may include one or more of the following elements, in any combination: a snowboard binding configured and operable to enable a user to release a snowboard at any time upon the initiative of the user, and the binding is configured to be only manually actuated; a snowboard binding configured and operable to enable a user to release a snowboard at any time upon the initiative of the user, and the binding is configured to be manually actuated by way of a cable and handle assembly; a snowboard binding configured and operable to enable a user to release a snowboard at any time upon the initiative of the user, and the binding is configured to be electronically and/or manually actuated; a snowboard binding configured and operable to enable a user to release a snowboard at any time upon the initiative of the user, and the binding is configured to be only electronically actuated; a snowboard binding configured and operable to enable a user to release a snowboard at any time upon the initiative of the user; a snowboard binding configured and operable to enable a user to release a snowboard at any time upon actuation of a wireless remote control that is in operable communication with the snowboard binding; a snowboard binding that comprises a retention and release assembly and a boot interface portion; a retention and release assembly and boot interface portion configured to releasably engage each other; a retention and release assembly and boot interface portion configured to releasably engage each other, and the retention and release assembly is operable with a wireless remote control; a boot interface portion; a boot interface portion configured to releasably engage with a retention and release assembly; a boot interface portion that includes one or more straps, buckles and/or other adjustable and/or nonadjustable retention devices operable to releasably secure a portion of a boot in the boot interface portion; a boot interface portion configured for rotational motion relative to a retention and release assembly; a retention and release assembly configured to interface with a snowboard; a retention and release assembly configured to interface with a binding mounting mechanism of a snowboard; a retention and release assembly configured to connect to a one or more corresponding structures of a snowboard; a retention and release assembly configured so that a boot interface portion can engage with, and disengage from, the retention and release assembly by way of a rotational movement of the boot interface portion; a retention and release assembly configured to releasably lock together with a boot interface portion; a retention and release assembly that is compatible for attachment to a snowboard that has a mounting channel; a wireless remote control device operable by a user to operate a retention and release assembly of a snowboard binding so as to enable the snowboard to be released by the user; a snowboard binding including electronics, which may be actuated remotely by a user, that are operable to emit an active locator signal perceptible by a user; a snowboard binding including electronics, which may or may not be actuated remotely by a user, that are operable to emit an active locator signal perceptible by an electronic signal detection device, such as an RF beacon; a snowboard binding including electronics, which may be actuated remotely by a user, that are operable to emit an active locator signal, and the active locator signal is any one or more of a visual signal, an audible signal, or an RF signal; a snowboard binding that includes a passive reflector which returns a signal upon receipt of an RF signal at a surface of the passive reflector; a snowboard binding that includes a passive reflector and also includes electronics, which may be actuated remotely by a user, that are operable to emit an active locator signal perceptible by a user; a snowboard with one, or two, snowboard bindings; and, a snowboard with any of the following combinations of binding types—2 electronically actuated, or 2 manually actuated, or 1 manually actuated and 1 electronically actuated, or 1 manually actuated and 1 conventional binding, or 1 electronically actuated and 1 conventional binding.

B. List of Some Illustrative Embodiments

Following is a list of various example embodiments of the invention. It should be noted that such embodiments, and the other embodiments disclosed herein, do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

In a first example embodiment, a binding for a snow sport device includes a boot interface portion and a remotely operable retention and release assembly, and the boot interface portion and the retention and release assembly are configured to releasably engage each other.

In a second example embodiment, a snowboard binding includes a boot interface portion and a remotely operable retention and release assembly, and the boot interface portion and the retention and release assembly are configured to releasably engage each other.

In a third example embodiment, a snowboard binding includes a boot interface portion and a remotely operable retention and release assembly, and the boot interface portion and the retention and release assembly are configured to releasably engage each other, and the boot interface portion is configured to removably receive a portion of a boot, and the retention and release assembly is configured to be mounted to a snowboard.

In a fourth example embodiment, a snowboard binding includes a boot interface portion and a remotely operable retention and release assembly, the boot interface portion and the retention and release assembly are configured to rotatably engage with, and disengage from, each other.

In a fifth example embodiment, a snowboard binding includes a boot interface portion and a remotely operable retention and release assembly that are configured to releasably engage each other such that rotation of the boot interface portion in a first direction engages the boot interface portion with the retention and release assembly, and rotation of the boot interface portion in a second direction disengages the boot interface portion from the retention and release assembly.

In a sixth example embodiment, a snowboard binding includes a boot interface portion and a retention and release assembly configured to releasably engage each other, and the retention and release assembly is remotely operable by a wireless electronic device.

In a seventh example embodiment, a snow sport device includes one or more bindings, and one or more of the bindings includes a boot interface portion and a remotely operable retention and release assembly mounted to the snow sport device, and the boot interface portion and the retention and release assembly are configured to releasably engage each other.

In an eighth example embodiment, a snowboard includes one or more bindings, and one or more of the bindings includes a boot interface portion and a remotely operable retention and release assembly mounted to the snowboard, and the boot interface portion and the retention and release assembly are configured to releasably engage each other.

In a ninth example embodiment, a snowboard includes one or more snowboard bindings, and one or more of the snowboard bindings includes a boot interface portion and a remotely operable retention and release assembly mounted to the snowboard, and the boot interface portion and the retention and release assembly are configured to releasably engage each other, and the retention and release assembly is remotely operable by a wireless electronic device.

In a tenth example embodiment, a snowboard includes one or more snowboard bindings, and one or more of the snowboard bindings includes a boot interface portion and a remotely operable retention and release assembly that are configured to releasably engage each other such that rotation of the boot interface portion in a first direction engages the boot interface portion with the retention and release assembly, and rotation of the boot interface portion in a second direction disengages the boot interface portion from the retention and release assembly.

In a eleventh example embodiment, a snowboard includes one or more bindings, and the snowboard includes one or more binding mounting devices, each in the form of one of a 2×4 bolt mounting pattern, a 4×4 bolt mounting pattern, a diamond shaped 3D bolt mounting pattern, or a channel system comprising 2 channels, and one or more of the bindings includes a boot interface portion and a remotely operable retention and release assembly mounted to the split board, and the boot interface portion and the retention and release assembly are configured to releasably engage each other.

In a twelfth example embodiment, a split board includes one or more bindings, and one or more of the bindings includes a boot interface portion and a remotely operable retention and release assembly mounted to the split board, and the boot interface portion and the retention and release assembly are configured to releasably engage each other.

In a thirteenth example embodiment, a snowboard binding includes a boot interface portion and a manually operable retention and release assembly, and the boot interface portion and the retention and release assembly are configured to releasably engage each other.

In a fourteenth example embodiment, a snowboard binding includes a boot interface portion and a manually operable retention and release assembly, and the boot interface portion and the retention and release assembly are configured to releasably engage each other, and the manually operable retention and release assembly includes a cable operably connected to one or more other components of the retention and release assembly and the cable is connected to a handle that may be connected to the boot interface portion and that is arranged to be grasped by a user such that the user can move the cable.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings.

DETAILED DESCRIPTION OF SOME EXAMPLE EMBODIMENTS

Figure 1:
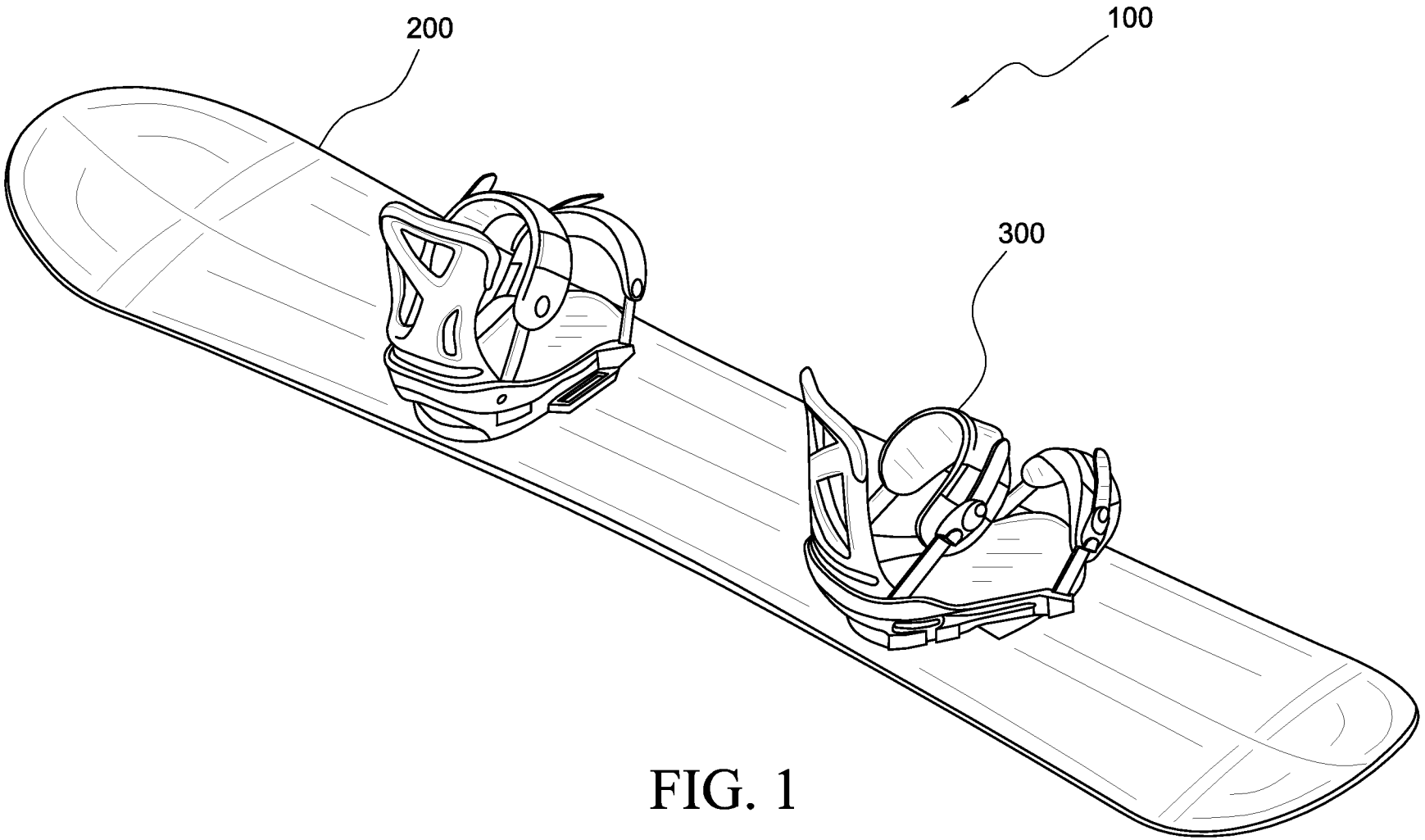
FIG. 1 discloses aspects of an example snowboard and bindings.

In general, embodiments of the invention are concerned with snow sport devices and associated bindings. One particular, but non-limiting, example of a snow sport device is a snowboard that includes a pair of snowboard bindings, each of which can accommodate a respective boot of a user and, more particularly, snowboard bindings that can release a snowboard at any time upon the initiative of the user. This release function of the snowboard binding can be effected remotely by a user with a wireless remote control. The remote control can be implemented in a variety of mechanisms, such as a key fob or smartphone, for example.

The snowboard binding may include a boot interface portion with buckles, clips and/or other retention devices that enable a user to removably retain his boot in the boot interface portion. The boot interface portion may include a spring-loaded pin that is biased so as to extend out of the boot interface portion and configured to be removably received in a corresponding recess defined by the retention and release assembly so that when the pin is so received, the boot interface portion and the retention and release assembly are locked together. In an alternative embodiment, the pin and recess arrangement is reversed so that the spring-loaded pin is included in the retention and release assembly and the recess is defined in the boot interface portion.

The retention and release assembly is configured to be attached to the upper surface of a snowboard by way of a mounting mechanism that is included as part of the snowboard. A generally circular housing is provided that houses the electronics for remote control of the retention and release assembly, and also houses a motor that is operable to effect motion of a plunger configured for reciprocal motion within the recess in which the spring-loaded pin is received so as to engage the spring-loaded pin of the boot interface portion. The housing includes a flange that engages corresponding structure of the boot interface portion so that the boot interface portion can rotate relative to the retention and release assembly when the boot interface portion and retention and release assembly are unlocked from each other.

In operation, a user can place the boot interface portion, within which his boot has been secured, on the housing so that the flange of the housing engages corresponding structure of the boot interface portion. As the user rotates the boot interface portion by movement of his foot, the spring-loaded pin of the boot interface portion is brought into alignment with, and extends into, the recess of the retention and release assembly housing, thus locking the boot interface position relative to the housing. After this operation is repeated for the other boot, the rider is locked to the snowboard. Note that in some alternative embodiments, only one of the snowboard bindings is configured to enable the boot interface portion to lock to, and release from, the snowboard, and the other snowboard binding is permanently fixed to the snowboard.

When the rider is ready to release the snowboard, actuation of the wireless remote control causes the motor to extend the plunger, which is in contact with the spring-loaded pin, thereby overcoming the bias imposed on the spring-loaded pin to move the spring-loaded pin into a position where it is fully received in the boot interface portion. A limit switch in the housing causes the operation of the motor to cease once the plunger has been extended as described. When the spring-loaded pin has been pushed back into the boot interface portion, the boot interface portion is then free to rotate relative to the retention and release assembly, and the user can then effect release of the snowboard by a short twist of the boot interface portion. To reattach the boot interface portion to the retention and release assembly, the user can actuate the remote control to reset the retention and release assembly by causing the motor to retract the plunger so that the spring-loaded pin can again be accommodated in the recess in which the plunger operates. The limit switch causes operation of the motor to stop once the plunger has been retracted fully.

Advantageously, embodiments of the invention enable a user to effect a positive locking of the boot interface portion to the retention and release assembly. This locking operation can be performed by the user solely as a manual process without requiring use of the wireless remote control. As well, the user can quickly and easily release the snowboard by simply actuating the wireless remote control and giving a short twist of his foot. Further, embodiments of the invention can be employed with known snowboard binding mounting mechanisms. Another advantage of the disclosed embodiments is that the bindings provide a significant level of convenience for the user in that the user can quickly, easily, and reliably, release one foot from the snowboard when the need arises, such as when a user is getting ready to ride a ski lift for example, or when a user needs to push himself through a flat spot in the terrain, for example.

A. General Aspects of Some Example Embodiments

In general, the snowboard bindings, snowboards, and remote control devices disclosed herein, may be constructed with a variety of components and materials including, but not limited to, adhesives, plastic, rubber, metal, fiberglass, composites, polytetrafluouroethylene (PTFE), carbon fiber, and any combination of these. Suitable metals may include brass, steel, titanium, aluminum, and aluminum alloys, although the skilled person will understand that a variety of other metals may be employed as well and the scope of the invention is not limited to the foregoing examples. These construction materials can be employed in connection with a variety of processes including, but not limited to, machining, injection molding, or die casting.

Depending upon the material(s) employed in the construction of the snowboards, snowboard bindings, and remote control devices, a variety of methods and components may be used to connect, releasably or permanently, various elements of the aforementioned devices. For example, the various elements of a snowboard binding within the scope of this disclosure may be attached to each other by any one or more of processes such as welding or brazing, and/or mechanically by way of fasteners such as bolts, screws, pins, and rivets, for example.

Some, none, or all of portions of a one or more of the snowboard, snowboard bindings, and remote control mechanisms and their components may be coated with paint, super-hydrophobic coatings, or other materials. At least some of such materials may serve to help prevent, or reduce, rust and corrosion. Surface treatments and textures may also be applied to portions of the snowboards, snowboard bindings, and remote control mechanisms. Such surface treatments can be configured and employed for circumstances where low friction is required between moving or movable parts, and also where relatively high friction, or resistance to motion, is required between moving or movable parts.

In at least some embodiments, the binding is configured so that the rear foot of the user is releasable, while the front foot is fixed to the snowboard. In other embodiments, the binding is configured so that the front foot of the user is releasable, while the rear foot is fixed to the snowboard. In still other embodiments, the bindings are configured so that both feet of the user are releasable from the snowboard.

B. General Aspects of an Example Snowboard Binding

With reference now to FIG. 1, an example snowboard assembly 100 includes a snowboard 200 to which a binding BOO is attached. The binding 300 is configured to releasably retain a snowboard boot (not shown). In this particular example, the snowboard 200 is a single piece snowboard. In other embodiments however, the snowboard 200 can be a split board such as used by backcountry snowboarders. In brief, a split board comprises two pieces that can be separated for touring in the backcountry, and that can then be reattached to each other and used as a snowboard. While some example snowboards and split boards are referenced herein, the scope of the invention is not limited to any particular snow sport device.

Figure 2A:
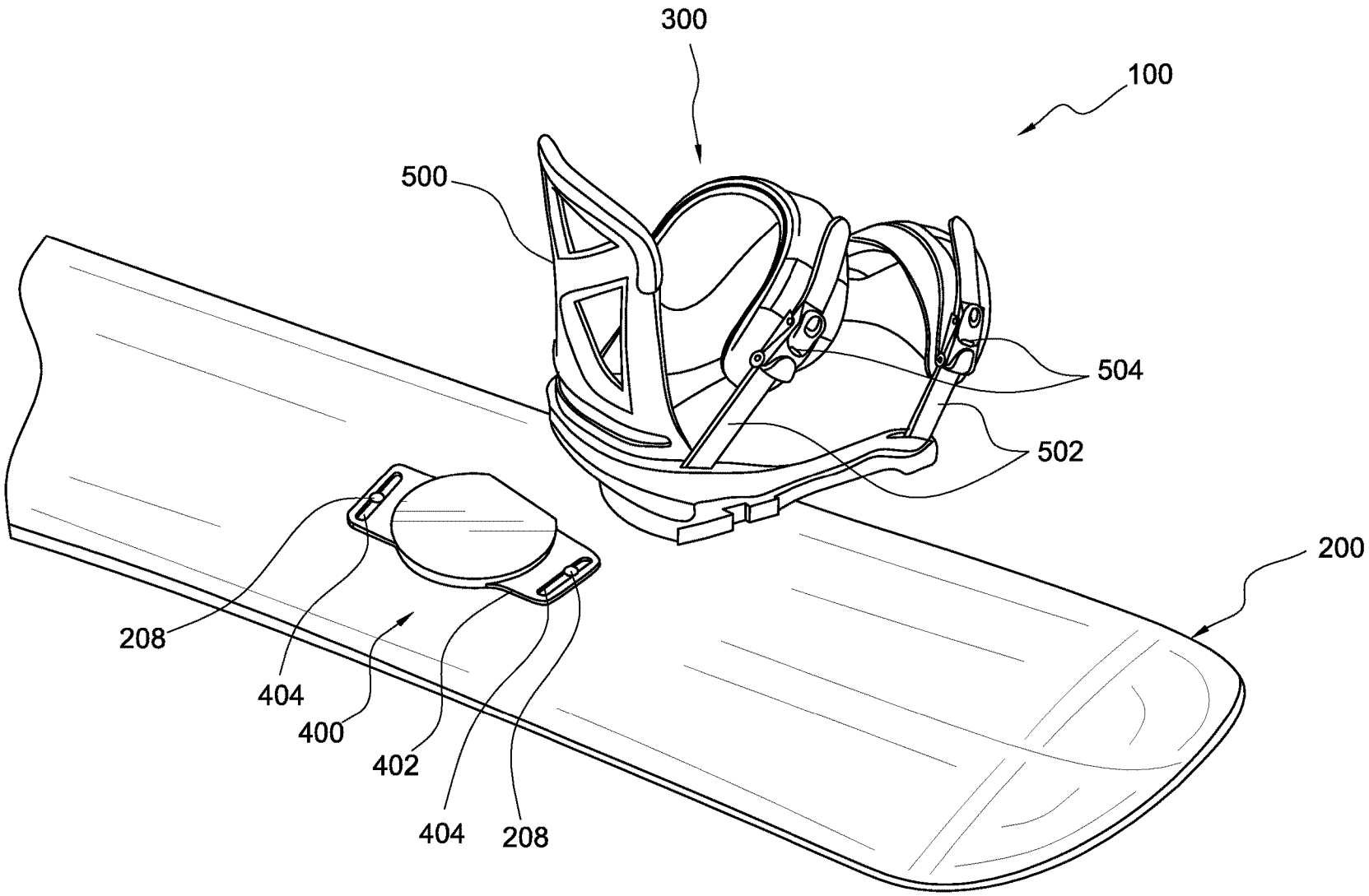
FIG. 2*a* discloses aspects of an example snowboard binding.
Figure 2B:
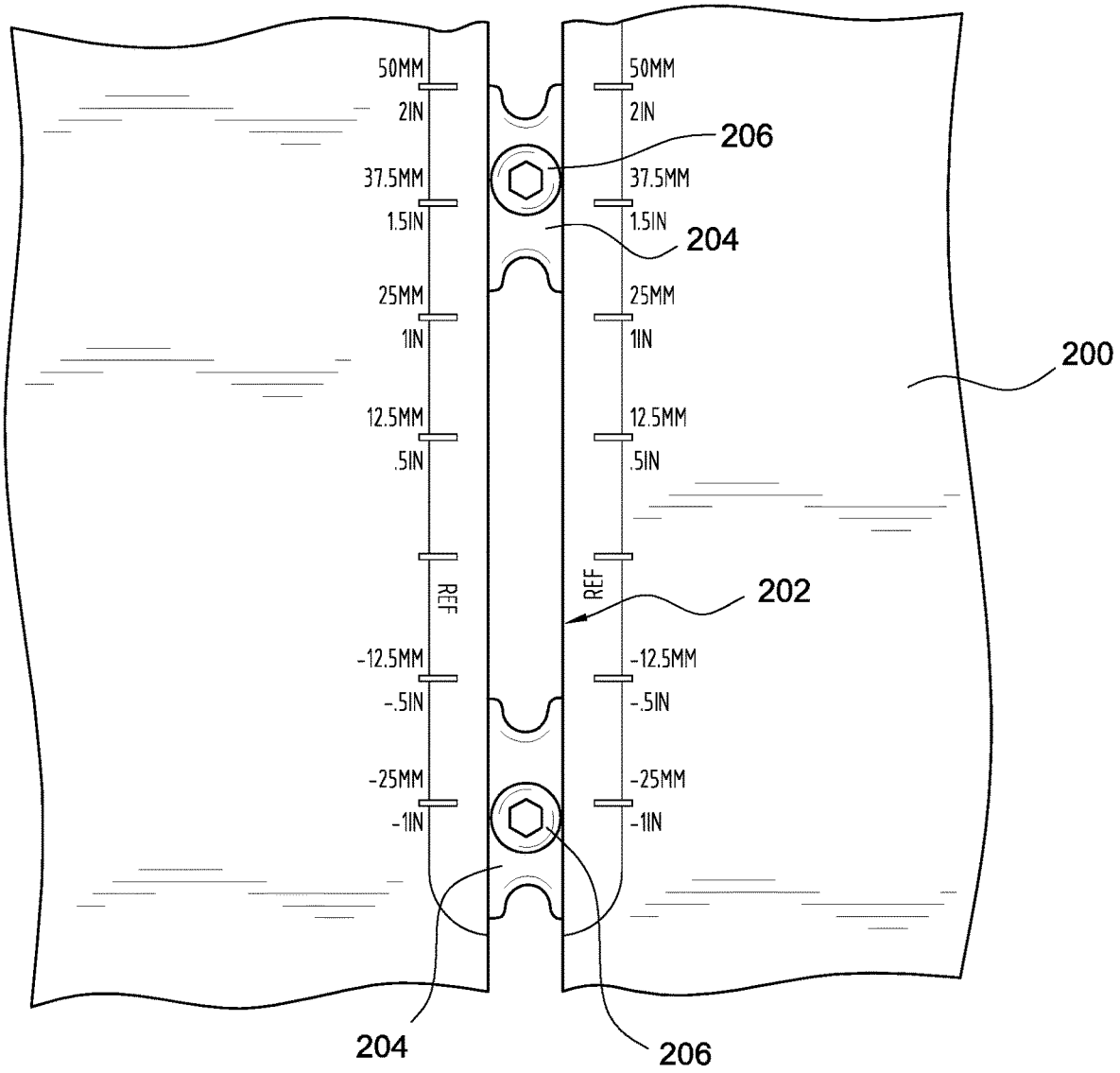
FIG. 2*b* discloses an example channel mount configuration for a snowboard binding.

With continued reference to FIG. 1, and directing attention now to FIGS. 2*a* and 2*b*, further details are provided concerning the configuration of the binding 300 as it relates to mounting on the snowboard 200. As shown in FIGS. 2*a* and 2*b*, the binding 300 includes a retention and release assembly 400 and boot interface portion 500 that are configured to releasably engage each other. The boot interface portion 500 may include one or more straps 502, buckles 504 and/or other retention devices to releasably retain a boot (not shown) in the boot interface portion 500.

As best shown in FIG. 2*b*, one embodiment of the snowboard 200 may define a pair of channels 202, each of which is configured to interface with a respective binding 300, although only a single binding 300 is indicated in FIG. 2*a*. The channel 202 slidingly receives a pair of retention elements 204 that can be moved along the channel 202 to a desired position. Each of the retention elements 204 defines a threaded recess 206 configured to receive a portion of a corresponding threaded fastener 208. One example of such a channel configuration is The Channel™ channel mount system configured for use with the Burton® EST snowboard binding.

The retention elements 204 are configured and arranged so that they cannot be pulled vertically out of the channel 202. In some cases, the retention elements 204 and channel 202 include respective teeth that engage with each other when the retention elements 204 are tightened so that the retention elements 204 cannot slide along the channel 202.

With particular reference to FIG. 2*a*, the fasteners 208 may be used to hold a baseplate 402 of the retention and release assembly 400 to the snowboard 200. In this particular embodiment, the baseplate 402 defines a pair of slots 404 through which one of the fasteners 208 passes. In some embodiments, a flange on each fastener 208 prevents the fastener from being pulled through the baseplate 402, while in other embodiments, the fasteners 208 can be employed with washers (not shown) for the same purpose. In general, the slots 404 are configured and arranged to enable a user to adjust the angle of the retention and release assembly 400 and, thus, the foot of the user, relative to the snowboard 200. Once the slots 404 are in the desired orientation, the fasteners 208 are then tightened to secure the retention and release assembly 400 to the snowboard 200.

C. Boot Interface Portion and Retention and Release Assembly

Figure 3A:
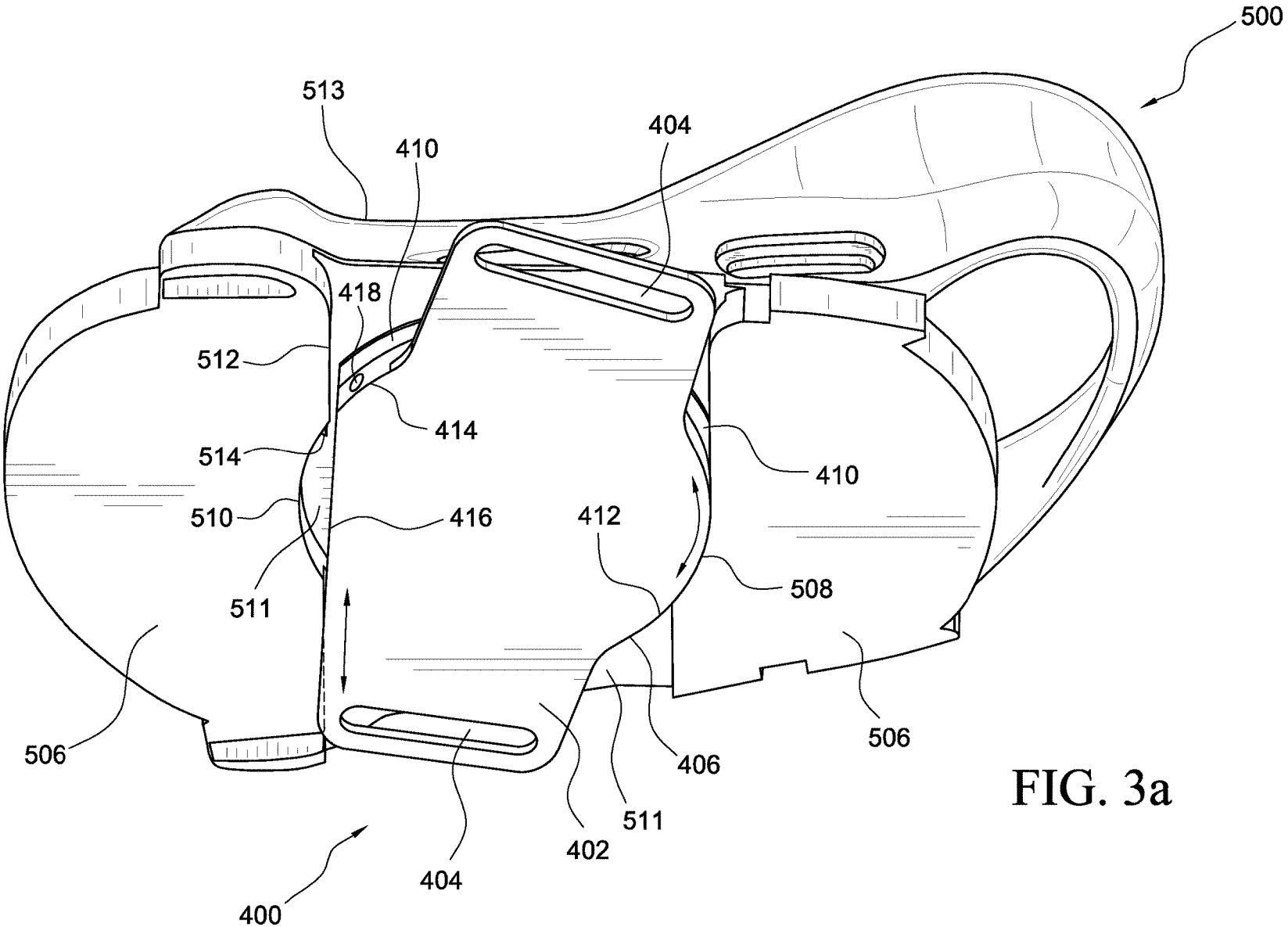
FIGS. 3*a*-3*j* disclose various aspects of an example remote release snowboard binding.
Figure 3B:
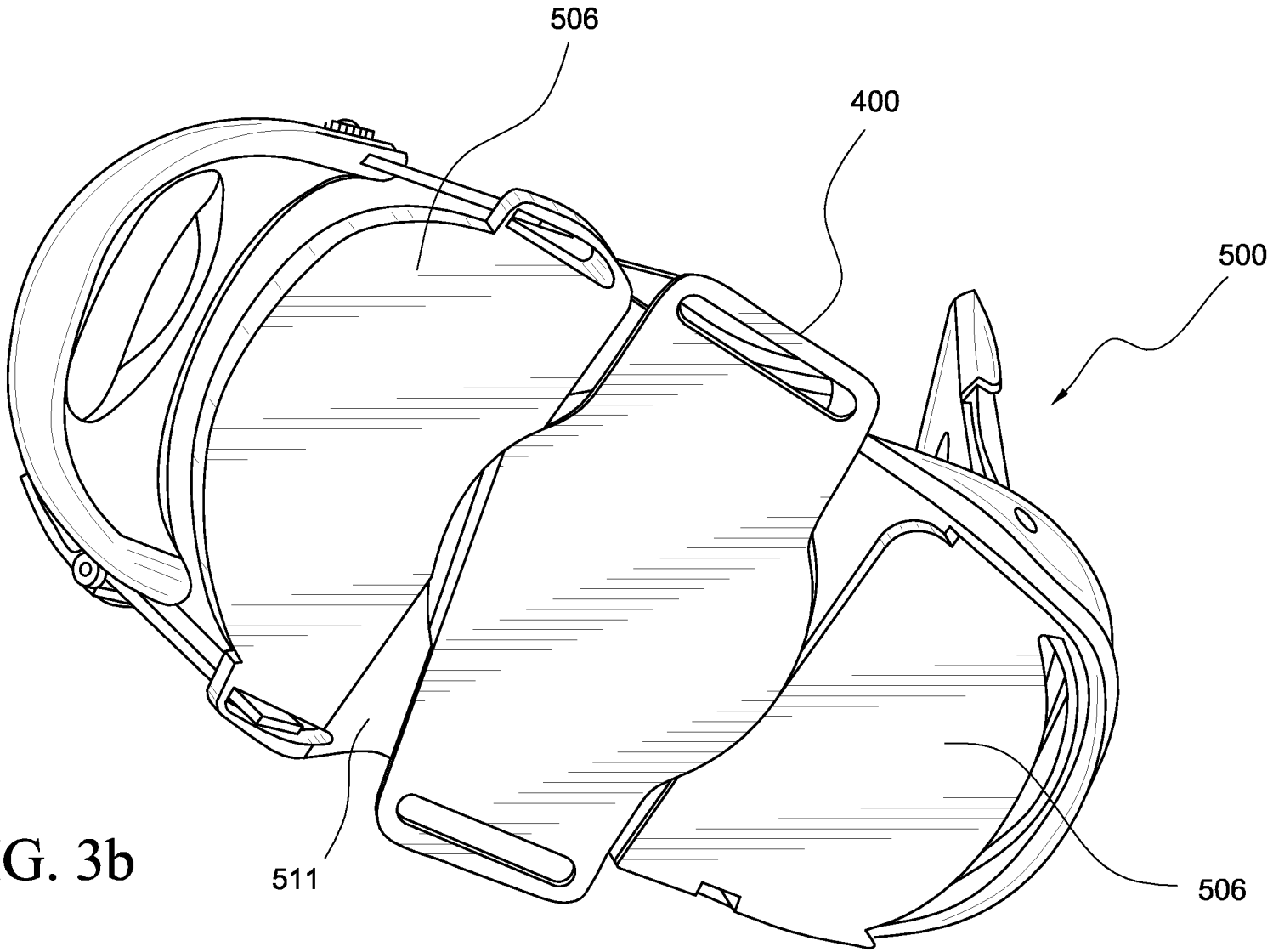
Figure 3C:
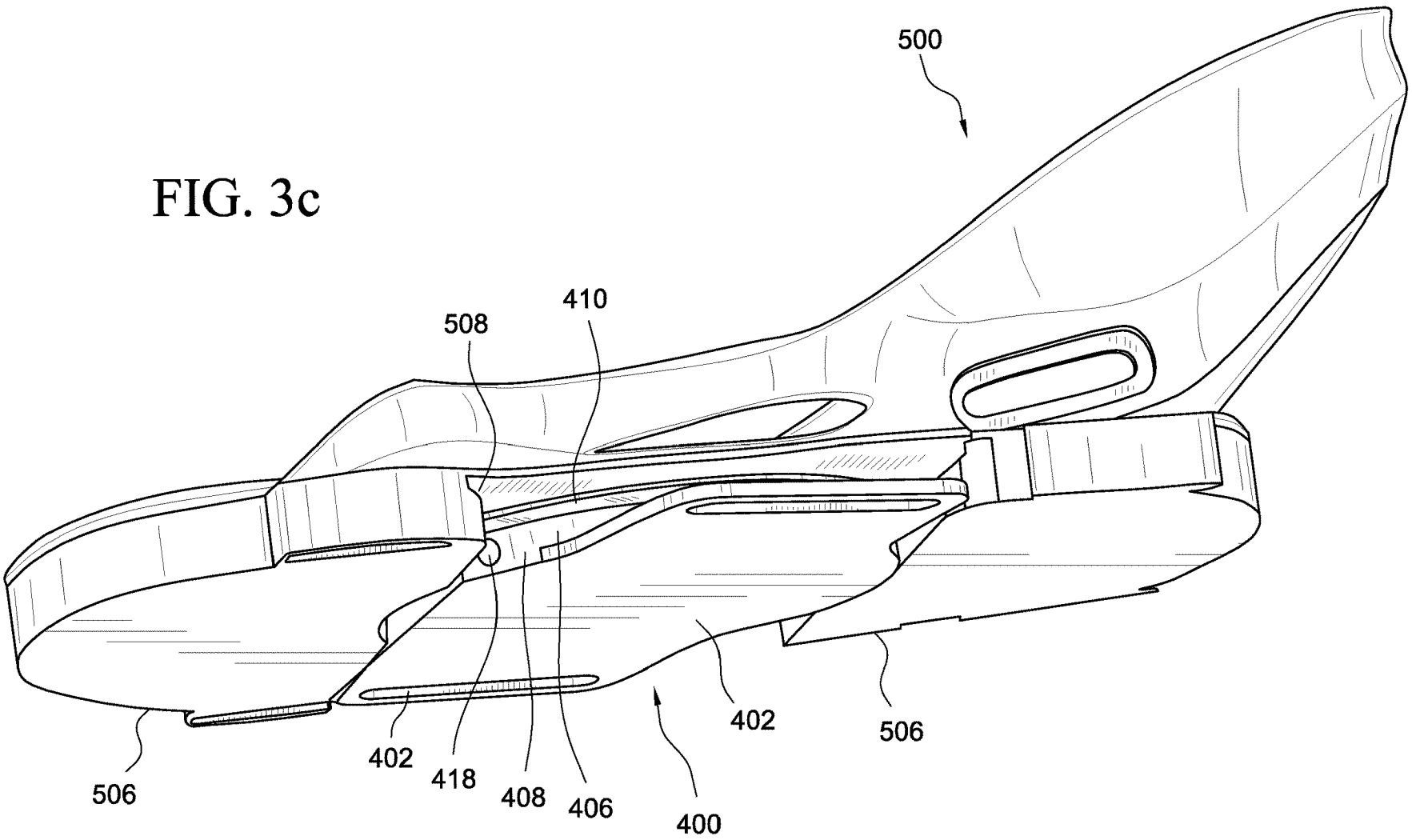
Figure 3D:
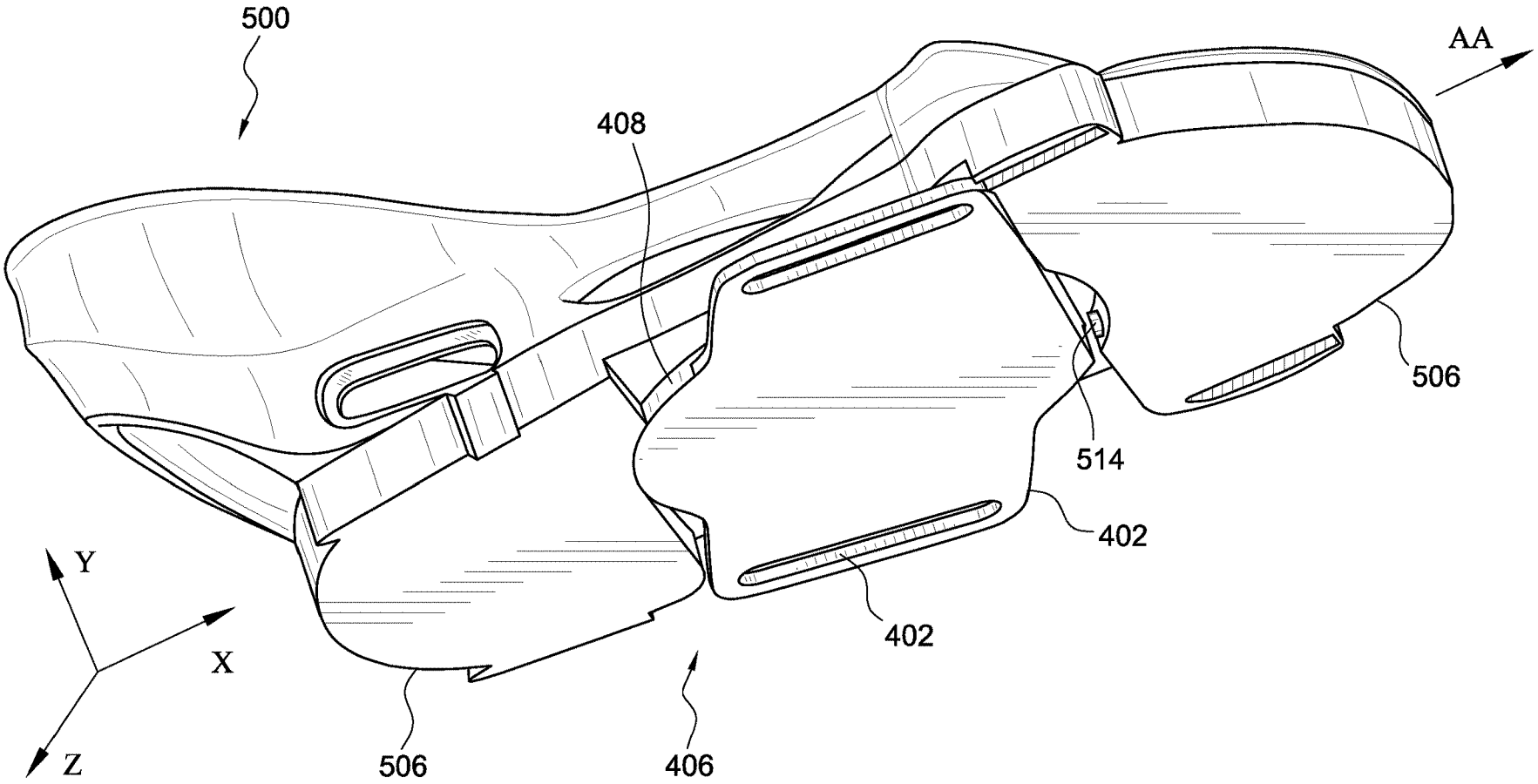
Figure 3E:
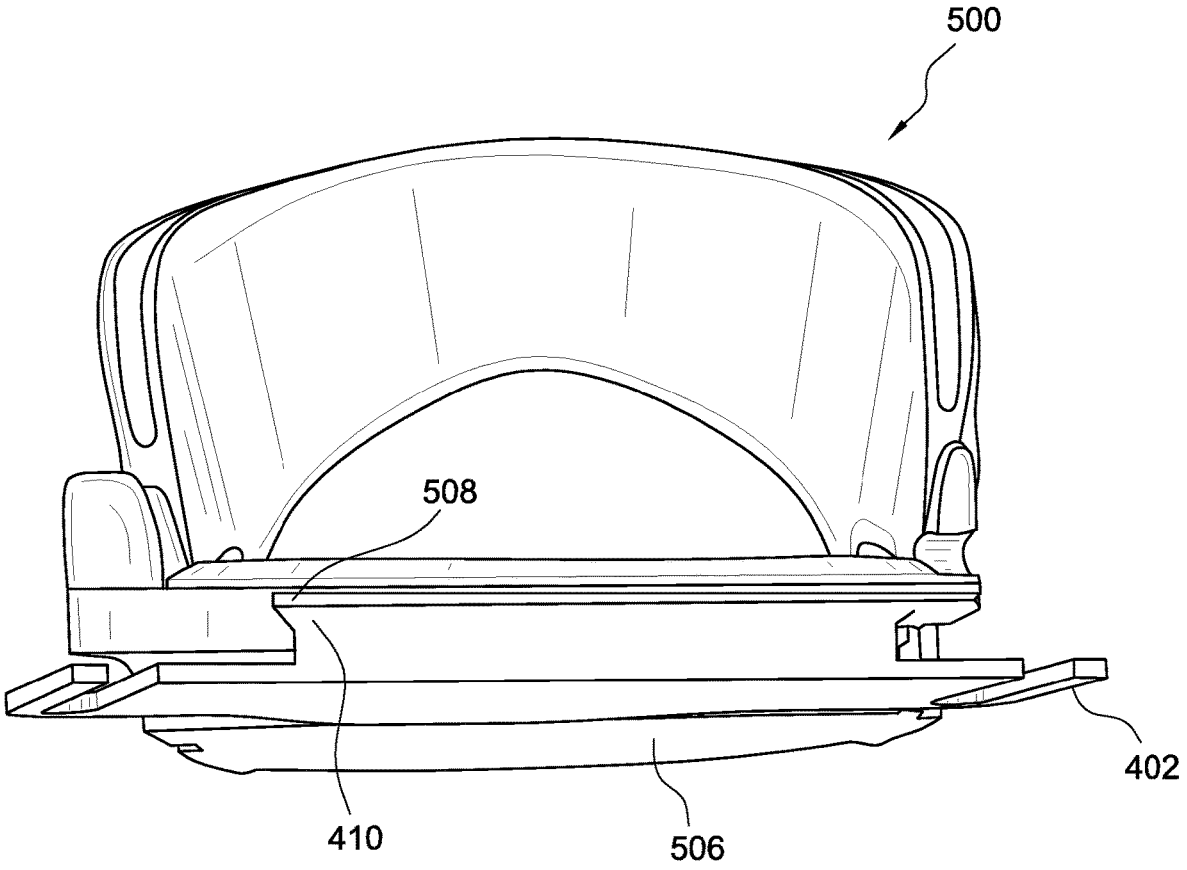

Turning now to FIGS. 3*a*-3*h*, details are provided concerning the configuration and operation of the retention and release assembly 400 and the boot interface portion 500. As shown in FIGS. 3*a*-3*c* for example, the retention and release assembly 400 and the boot interface portion 500 are respectively configured so that when those two elements are engaged with each other, the bottom of the baseplate 402 is flush, or substantially so, with the sole 506 of the of the boot interface portion 500. In general, FIG. 3*a* shows the boot interface portion 500 fully engaged with, but not locked to, the retention and release assembly 400, while FIG. 3*b* shows the boot interface portion 500 fully engaged with, and also locked to, the retention and release assembly 400.

As disclosed herein, the boot interface portion 500 may be made in whole or in part of plastic, and the boot interface portion 500 may have an integral, single piece construction. The baseplate 402 may be made in whole or in part of metal, such as aluminum or an aluminum alloy for example.

As best shown in FIGS. 3*a* and 3*c*, the baseplate 402 forms part of a housing 406 of the retention and release assembly 400. The housing 406 additionally includes a sidewall 408 that cooperates with the baseplate 402 to define part of an enclosure in which various electronic, and other, components are received (see FIGS. 4*a*-4*c*). At its bottom edge, the sidewall 408 connects to the baseplate 402, and a flange 410 is located at the top edge of the sidewall 408.

With continuing reference to FIGS. 3*a* and 3*c* in particular, the baseplate 402 includes a first curved portion 412 and a second curved portion 414, each of which is configured and arranged to engage, and rotate relative to, corresponding first curved portion 508 and second curved portion 510 of the boot interface portion 500. As shown in FIGS. 3*a*-3*c*, the configuration of the baseplate 402 and the sole 506 are such that when those two elements are engaged, the baseplate 402 cannot translate laterally, that is, in the X-direction (see FIG. 3*d*), relative to the sole 506. As well, the baseplate 402 includes a straight side 416 configured and arranged to engage, and slide along, a straight edge 512 of the sole 506. Thus, when the sole 506 is oriented as shown in FIG. 3*a*, the boot interface portion 500 can be slid out of engagement with the housing 406.

Figure 3F:
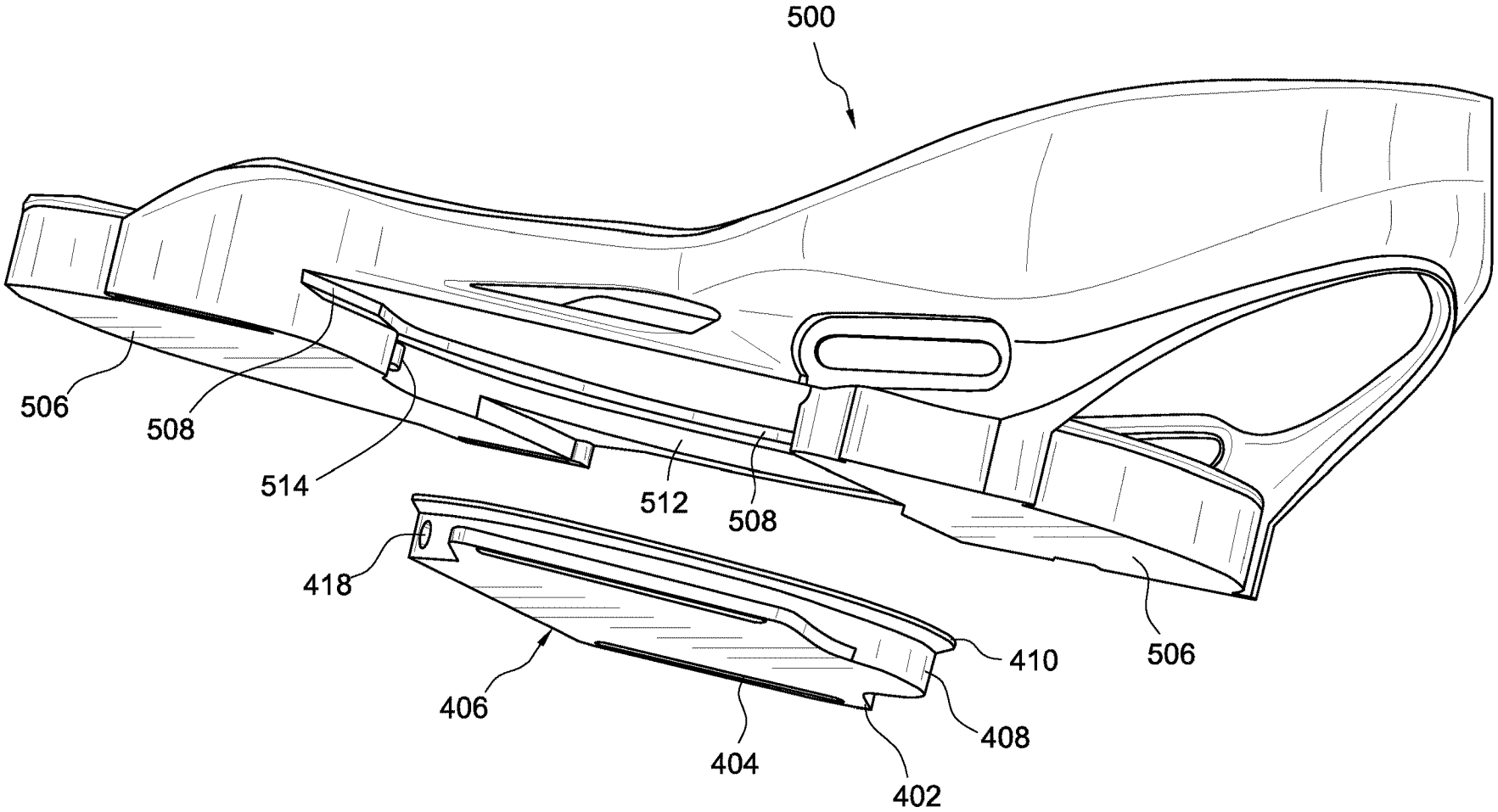
Figure 3G:
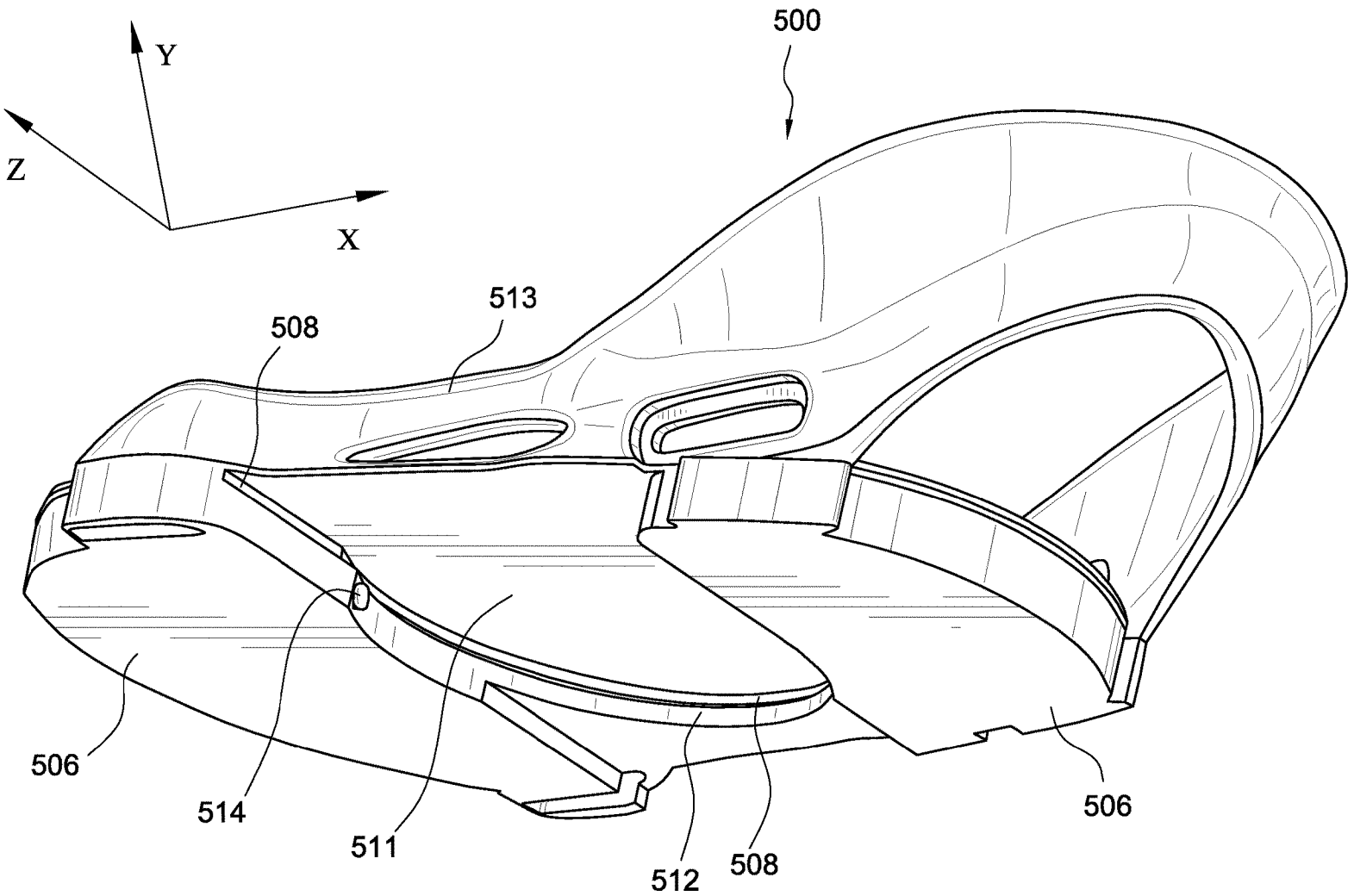
Figure 3H:
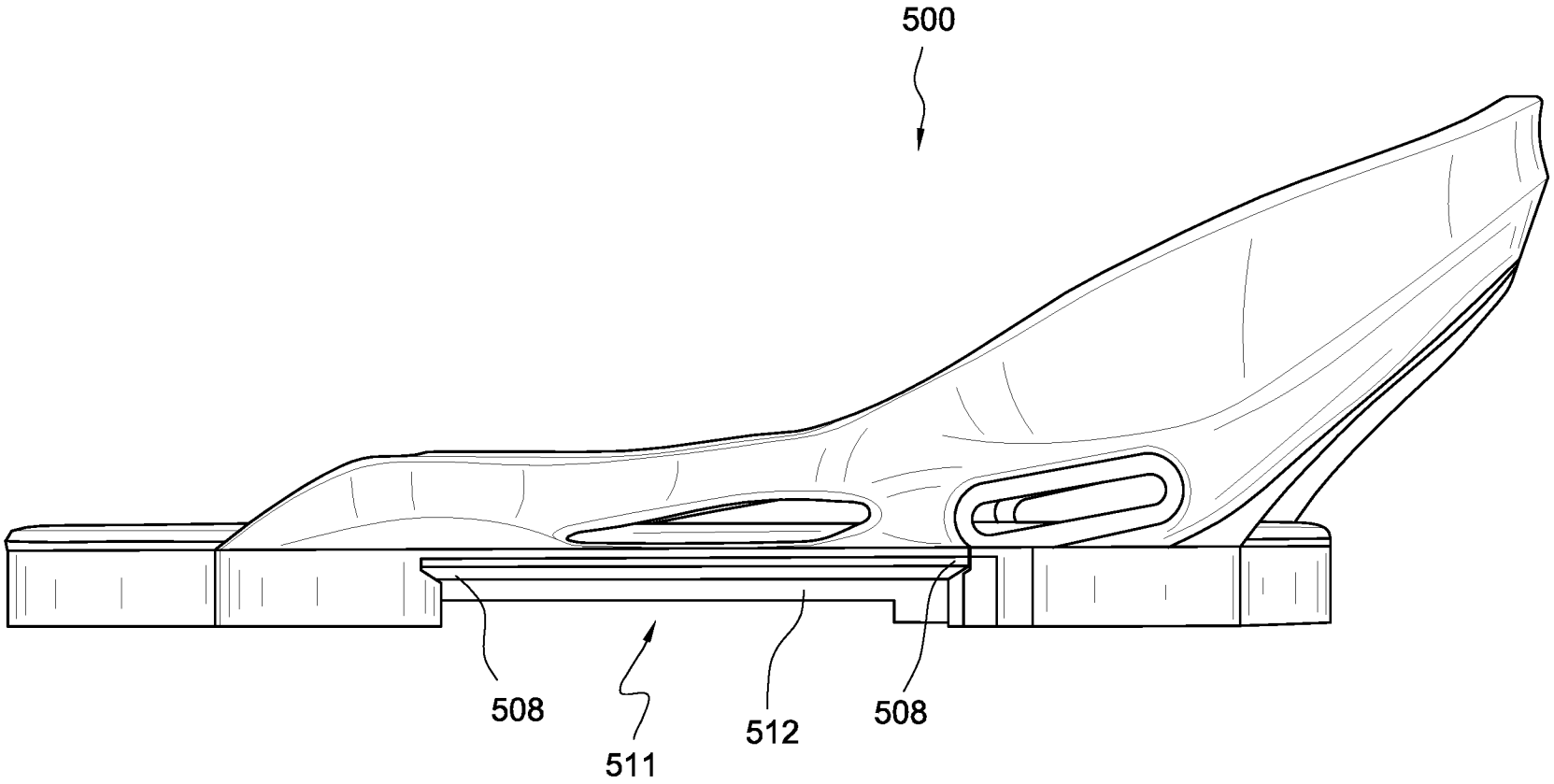
Figure 3I:
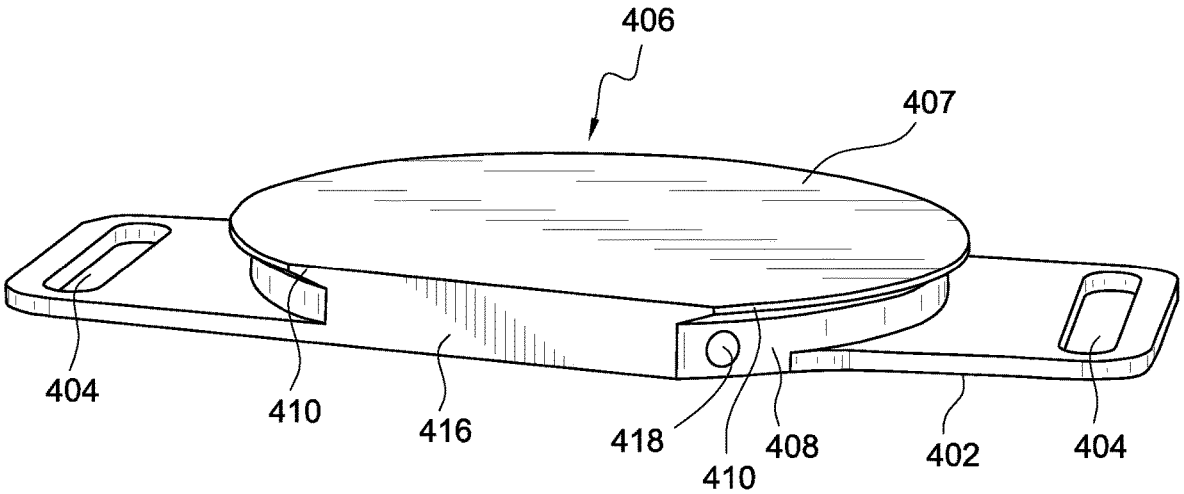
Figure 3J:
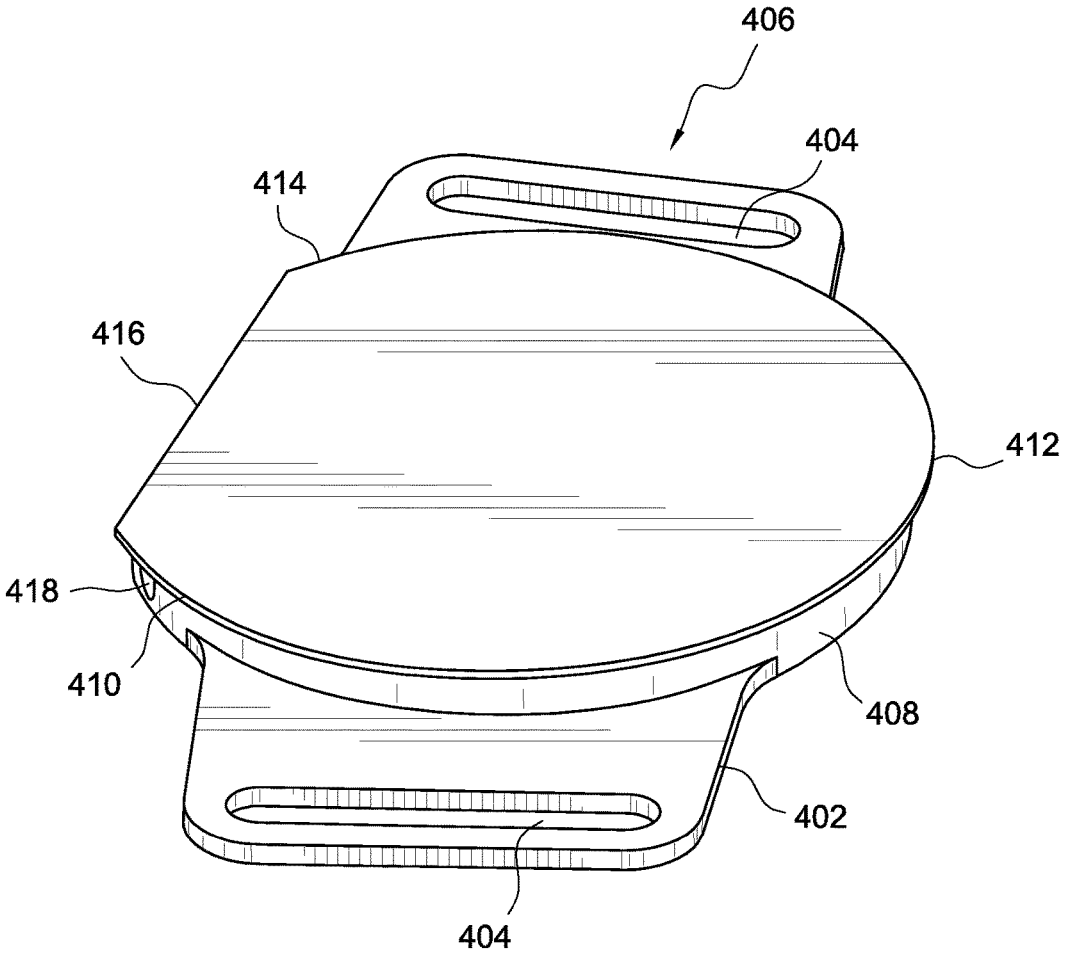

Turning now to FIGS. 3*d*-3*i*, and with continued attention as well to FIGS. 3*a*-3*c*, details are provided concerning the structures that enable the retention and release assembly 400 and boot interface portion 500 to releasably engage each other. As shown, the sole 506 of the boot interface portion 500 defines an undercut 508 that is generally laid out in a U-shape, as best shown in FIG. 3*f*. The undercut 508 is configured to receive the flange 410 of the retention and release assembly 400, as best shown in FIG. 3*g*. This configuration and arrangement of the flange 410 and undercut 508 prevents movement of the boot interface portion 500 in the Y-direction (see FIG. 3*d*) relative to the retention and release assembly 400. Thus, the only way that the boot interface portion 500 can be disengaged completely from the retention and release assembly 400 is to slide, or translate, the boot interface portion 500 in the Z-direction (see FIG. 3*d*) that is, in a direction laterally and generally perpendicular relative to a longitudinal axis AA of the sole 506.

Moreover, because the recess 511 of the sole 506 is closed at one side by a sidewall 512 (see FIG. 3*f*), and narrowed by the presence of the first curved portion 508 of the sole 506, the range of lateral movement of the boot interface portion 500 relative to the retention and release assembly 400 is limited by the sidewall 512 and by the first curved portion 508, thus helping to ensure that the boot interface portion 500 is properly positioned relative to the retention and release assembly 400 before the boot interface portion 500 and retention and release assembly 400 are locked together. Correspondingly, the sidewall 512 and first curved portion 508 of the sole 506 may provide tactile feedback to the user by preventing further motion of the boot interface portion 500 when the boot interface portion 500 is fully received by the retention and release assembly 400. Thus, and with reference to the example of FIGS. 3*a* and 3*f*, there is only one way that the user can engage the boot interface portion 500 with the retention and release assembly 400, and that is by sliding the instep 513 of the boot interface portion 500 onto the retention and release assembly 400.

With particular reference now to FIGS. 3*a*, 3*f*, 3*h* and 3*i*, it can be seen that the boot interface portion 500 includes a pin 514 that is biased outwardly into the recess 511, such as by way of a spring (not shown) or comparable device. Thus, when the boot interface portion 500 is moved laterally into engagement with the retention and release assembly 400, and after the boot interface portion 500 is fully seated in the retention and release assembly 400 (see, e.g., FIG. 3*a*), the user may then rotate (counterclockwise in FIG. 3*a*) the boot interface portion 500 until the pin 514 is aligned with the bore 418 in the sidewall 408 of the retention and release assembly 400, at which time the spring-loaded pin 514 extends into the bore 418, thus securing the boot interface portion 500 from rotational motion relative to the retention and release assembly, and also locking the boot interface portion 500 to the retention and release assembly 400. The tip of the spring-loaded pin 514 may be beveled, or otherwise angled, similar to the way in which the bolt of a door lock is angled, to better enable displacement of the spring-loaded pin 514 by the curved second portion 414 (see, e.g., FIG. 3*a*) of the baseplate 412 as the boot interface portion 500 is rotated into the locked position.

In some embodiments, respective indexing or alignment marks (not shown) can be provided on the boot interface portion 500 and on the retention and release assembly 400, such as on the baseplate 402. Such indexing marks may enable the user to visually confirm whether or not the boot interface portion 500 and the retention and release assembly 400 are locked together. Additionally, or alternatively, the binding 300 may include one or more lights, such as an LED, that indicate whether or not the boot interface portion 500 and the retention and release assembly 400 are locked together. For example, a red LED indicates that locking has not occurred, while a green LED indicates that locking is complete. Such lights can be mounted in any suitable location where they would be visible to the user. Another example of a feature that may be included in any of the disclosed embodiments is a device for emitting one or more sounds, such as when battery power drops below a specified level, when a remote control has been turned on/off, when a user needs to locate his board in a rack at a ski resort, or in conjunction with the operation of an electronic anti-theft lock which may be integrated into a snowboard binding. Such a device may be electrically connected to, and may communicate with, a remote control device and/or to a retention and release assembly of a snowboard binding.

D. Details Regarding an Example Retention Mechanism

Figure 4A:
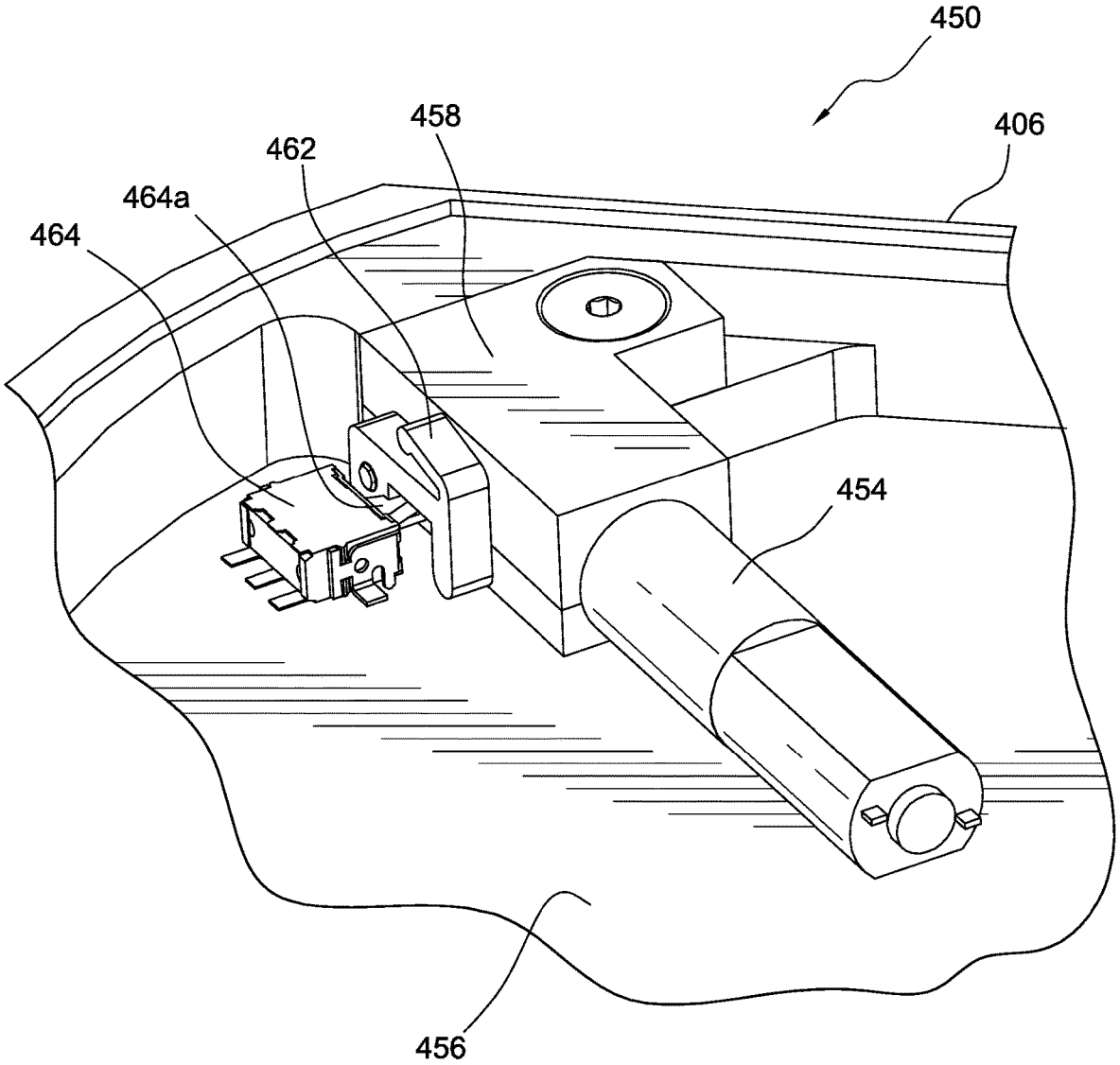
FIGS. 4*a*-4*c* disclose aspects of an example retention and release assembly.
Figure 4B:
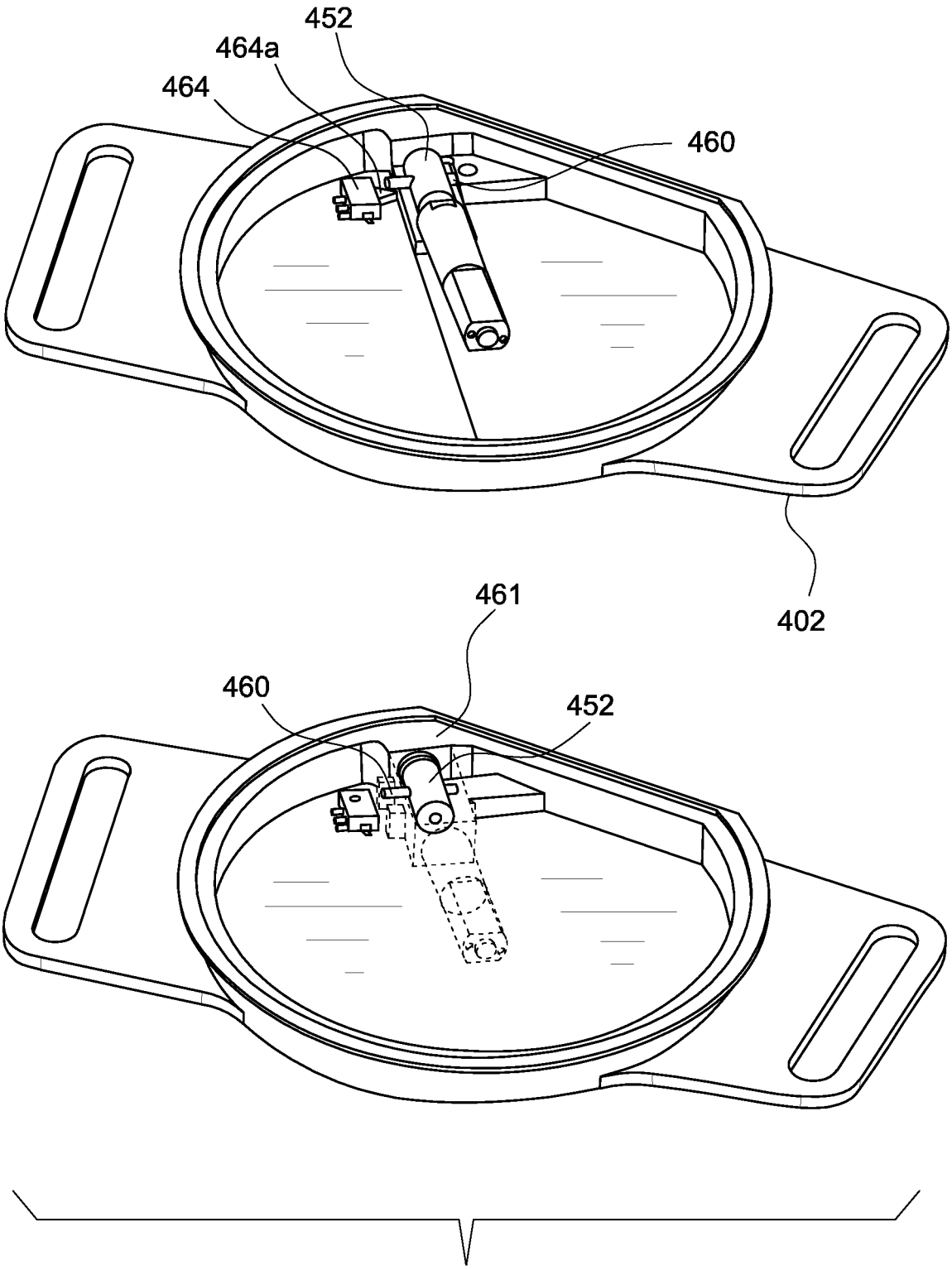
Figure 4C:
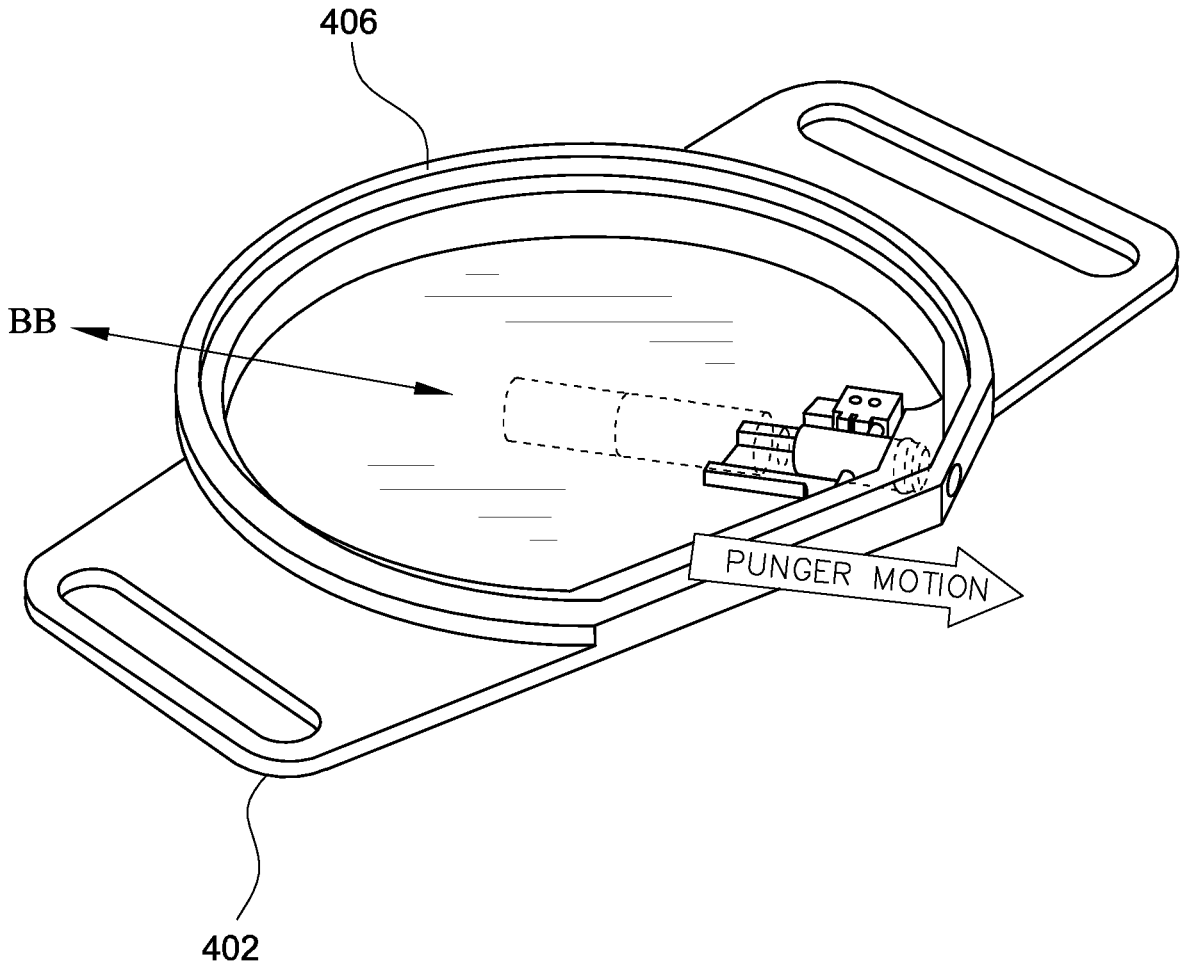

With reference now to FIGS. 4*a*-4*c*, further details are provided regarding the configuration and operation of the retention and release assembly 400. As indicated, the housing 406 is configured to hold various elements of a retention mechanism 450. Thus, the housing 406 may include a separate detachable cover 407 that may be sealed to another portion of the housing 406 by a sealing element, such as an O-ring for example. The detachable cover 407 may enable access to the retention mechanism 450 so that elements of the retention mechanism 450 can be repaired or replaced, and/or so that software stored on computer readable media in the housing 406 can be updated. In some embodiments, such software, which may be firmware, can be updated wirelessly using a computing device and/or a wireless remote control.

In general, the retention mechanism 450 includes a plunger 452 configured for reciprocal motion under the influence of a motor 454 that is electrically powered by a power source 456 such as a battery. The motor 454 is held in position by a motor clamp 458. A cross pin 460 in the plunger 452 carries a limit switch actuator 462 that is configured to interface with a limit switch 464. The cross pin 460 is also operable to stop, or prevent, counter-rotation of the plunger 452. Circuitry 600, which is configured for wireless communication with one or more external electronic devices, such as a remote control for example, is connected with the power source 456, motor 454, and the limit switch 464. Further details concerning the configuration and operation of the circuitry 600, which forms part of a control system, are provided in FIG. 6. In general however, the circuitry 600 enables remote operation of the plunger 452 so as to allow a user to disengage the boot interface portion from the retention and release assembly 400.

With particular reference to the motor 454 and plunger 452, the motor 454 may include a threaded shaft that engages a corresponding threaded hole in the rear of the plunger 452 so that as the motor 454 shaft rotates, the plunger 452 is advanced or retracted depending upon the direction of the rotation of the motor 454 shaft. As noted above, the plunger 452 includes cross pin 460 that carries limit switch actuator 462 and is arranged transverse to a longitudinal axis BB defined by the plunger 452. Thus, as the plunger 452 moves back and forth along axis BB, the cross pin 460 moves in unison with the plunger 452. In some embodiments, a sealing element 461, which may be made of rubber, silicone, or other suitable compliant materials, is provided in the wall 408 about the plunger 452 so as to help prevent the ingress of snow, ice, water and other foreign materials to the housing 406.

The motion of the cross pin 460 causes a corresponding back and forth motion of the limit switch actuator 462 that is carried by the cross pin 460. In general, the limit switch actuator 462 interfaces with the limit switch 464, which may be a 2 position limit switch. When actuated, the limit switch 464 cuts power to the motor 454 so that movement of the plunger 452, connected to the motor 454, ceases. In more detail, the limit switch 464 includes a switch arm 464*a* that interacts with limit switch actuator 462 such that power to the motor 454 will be cut by the limit switch 464 when the limit switch actuator 462 and, accordingly, the plunger 452, assumes one or the other of first and second prescribed positions between which the plunger 452 moves under the influence of the motor 454. More specifically, movement of the limit switch actuator 462 causes a corresponding movement of the switch arm 464*a* of the limit switch 464, and when the switch arm 464*a* is moved by the limit switch actuator 462 to either of a first (see FIG. 4*a*), or second opposing, position, the limit switch 464 operates to cut power to the motor 454. That is, when the plunger 452 is not in either of the aforementioned prescribed positions, power will continue to be supplied to the motor 454 until the plunger 452 has moved into one of those prescribed positions. It should be noted that in the interest of clarity, the limit switch actuator 462 is not shown in FIG. 4*b*.

In the first prescribed position, the terminal end of the plunger 452 is generally flush with the outer surface of the wall 408, thus preventing the spring loaded pin 514 of the boot interface portion 500 from entering the bore 418 within which the plunger 452 travels. Because the spring loaded pin 514 is not disposed in the bore 418, the boot interface portion 500 is in an unlocked state with respect to the retention and release assembly 400, and can thus rotate relative to, and be disengaged from, the retention and release assembly 400. In the second prescribed position, the terminal end of the plunger 452 has been retracted with the bore 418, so that a space is defined in the bore 418 between the outer surface of the wall 408 and the terminal end of the plunger 452. This space is able to accommodate a portion of the spring loaded pin 514 of the boot interface portion 500. Because the spring loaded pin 514 is partly disposed in the bore 418, the boot interface portion 500 is in a locked state with respect to the retention and release assembly 400, and in that state, cannot rotate relative to, or be disengaged from, the retention and release assembly 400.

With more particular reference to the limit switch actuator 462 and limit switch 464, when the limit switch actuator 462 moves into a position that corresponds to either the first or second prescribed position, the limit switch actuator 462 carried by the plunger 452 physically engages an electromechanical element, that is, the switch arm 464*a*, of the limit switch 464 which then opens the switch, cutting power to the motor 454. Thus, once the plunger 452 is in either of the two prescribed positions, the motor 454 ceases operation, and the plunger 452 stops moving, because the limit switch 464 has cut power to the motor 454.

When the user wants to release the snowboard, the user may employ a wireless remote control device to cause the circuitry 600 to activate the motor 454 by enabling power from the power source 456 to be supplied to the motor 454. The motor 454 then moves the plunger 452, which is then in the second prescribed position, to the first prescribed position, thus unlocking the boot interface portion 500 from the retention and release assembly 400 as described above, at which point the power to the motor 454 is cut by the limit switch 464. In some embodiments, a timer circuit can be included as part of the circuitry 600 so that after a set period of time, such as about 10 seconds for example, power is again supplied to the motor 454 which then moves the plunger 452 back to the retracted, second prescribed, position, at which point the power to the motor 454 is again cut by the limit switch 464.

E. Aspects of Binding Operation

Figure 5A:
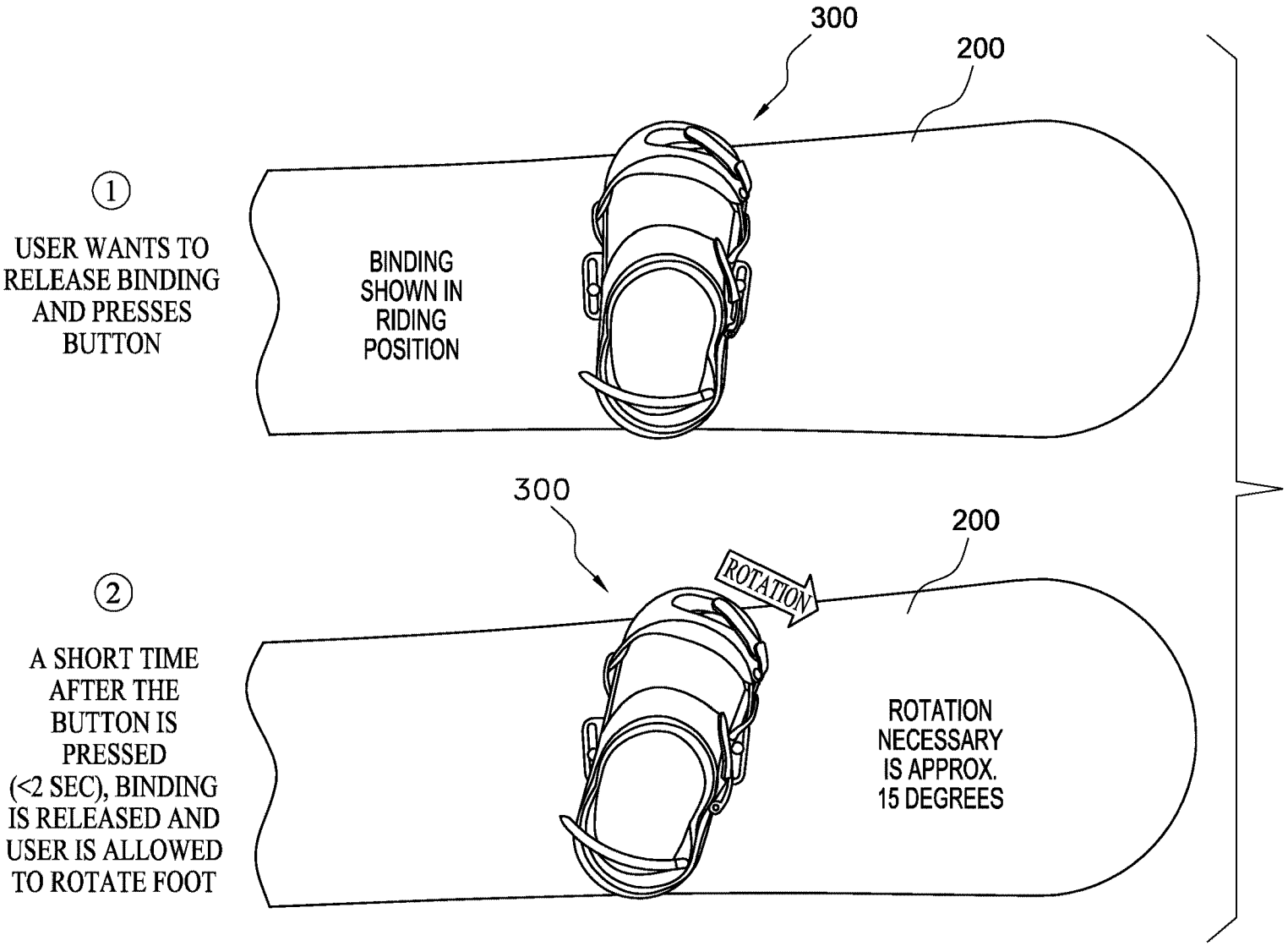
FIGS. 5*a*-5*d* disclose various operational aspects of an example remote release snowboard binding.
Figure 5B:
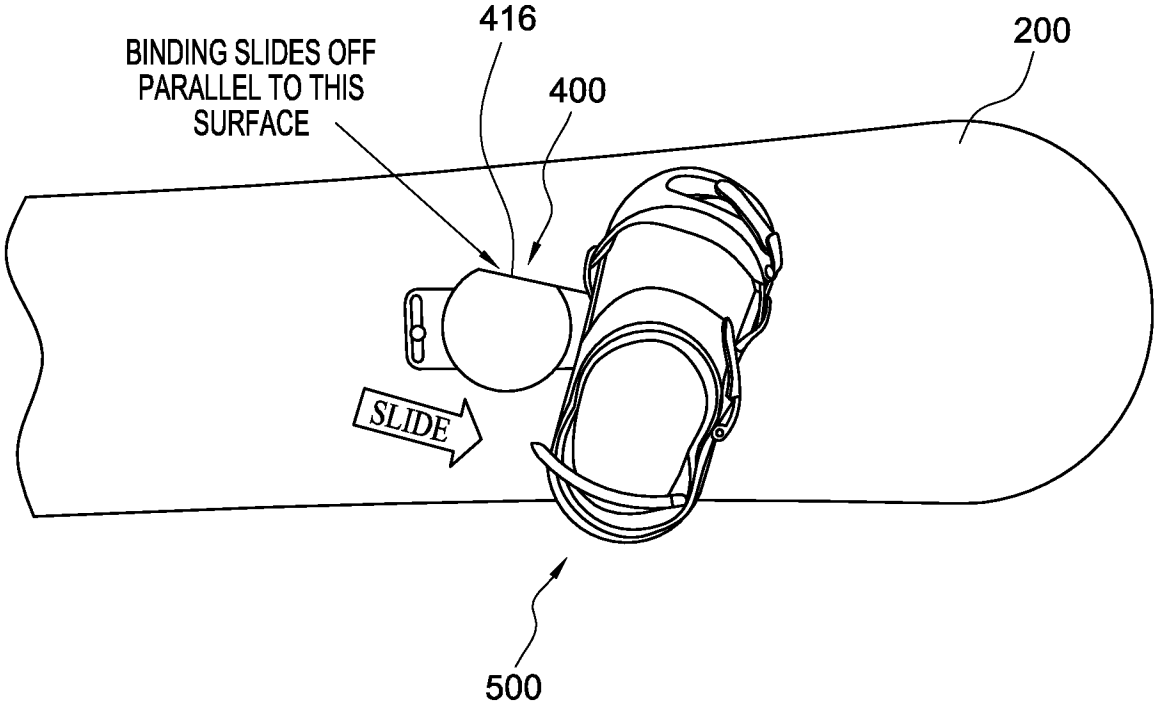

With reference now to FIGS. 5*a*-5*d*, further details are provided concerning user operation of the binding 300. In particular, illustrative states or positions of the binding 300 are indicated. With reference first to FIG. 5*a*, the binding 300 is shown in a riding position in which the user is locked to the snowboard 200 by way of the binding 300. To release the snowboard 200, the user can then activate a wireless remote control, such as by pressing a button for example, and after a pre-set time period which may be less than about 2 seconds for example, the boot interface portion 500 is unlocked from the retention and release assembly 400, in the manner disclosed elsewhere herein. After unlocking occurs, the user can then rotate his foot in the direction indicated and then slide the boot interface portion 500 out of engagement with the retention and release assembly 400. Some embodiments of the binding 300 are configured so that a clockwise foot rotation of about 15 degrees is adequate to allow the user to disengage the boot interface portion 500 from the retention and release assembly 400, although greater or smaller rotational angles could be used.

Figure 5C:
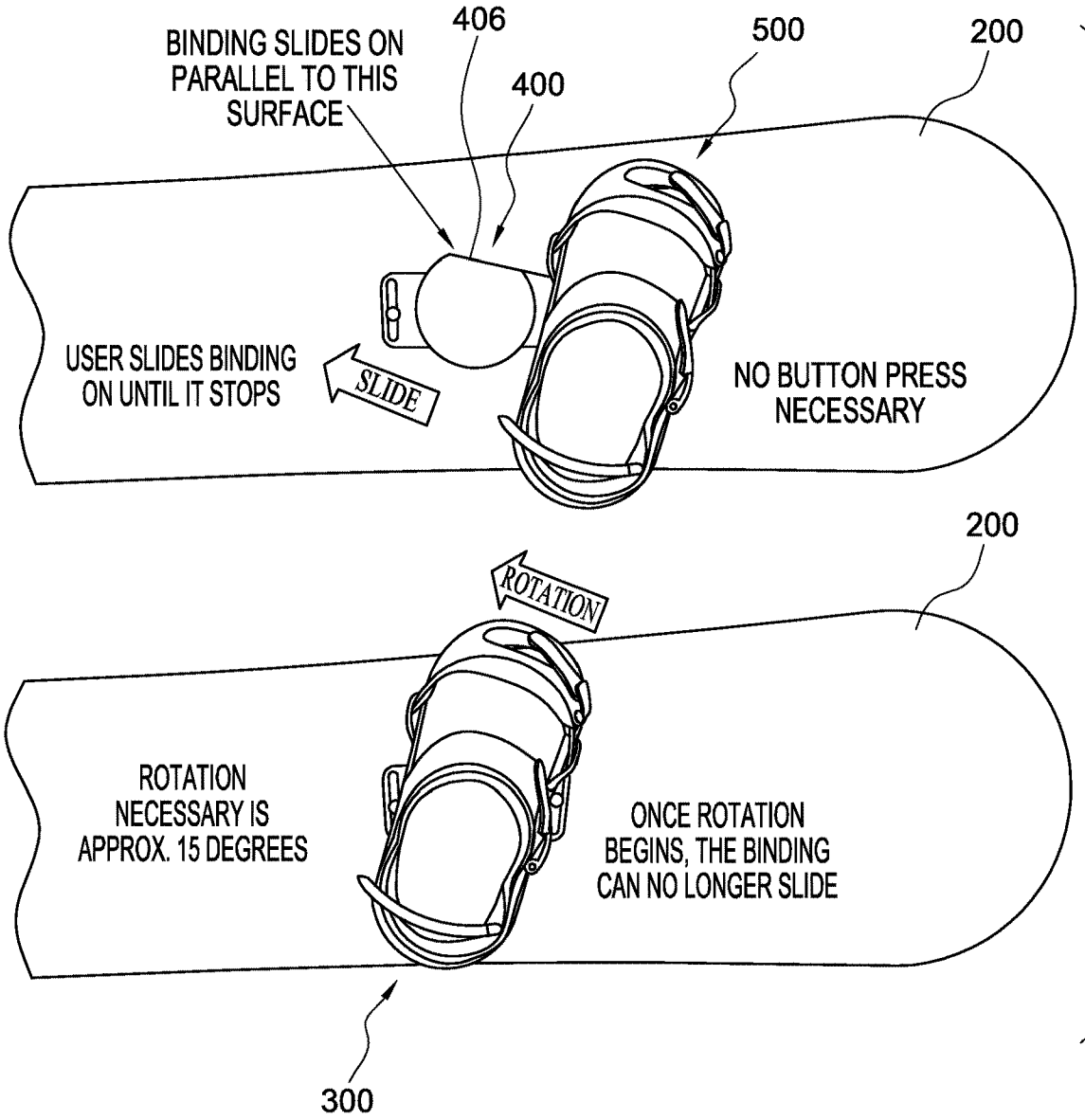
Figure 5D:
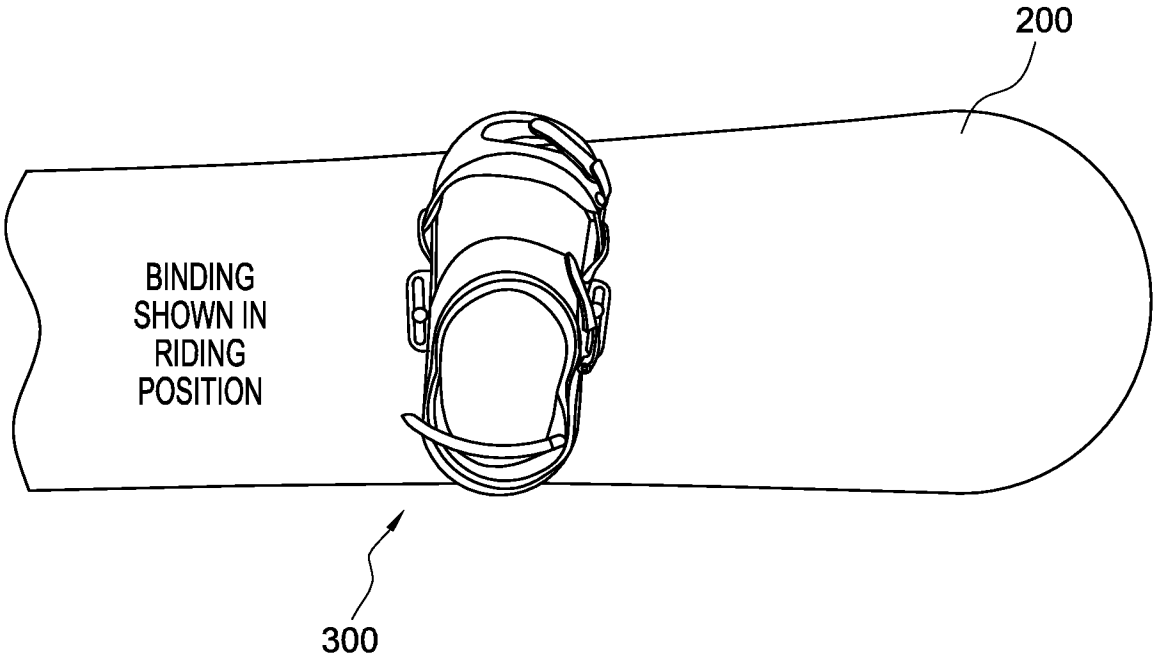

To reengage the boot interface portion 500 with the retention and release assembly 400 prior to riding, the user can slide the boot interface portion 500 into engagement with the retention and release assembly 400 in the direction indicated in FIG. 5*c* until further movement of the boot interface portion 500 is not possible. The user can then rotate his foot counterclockwise, about 15 degrees in some embodiments, until the boot interface portion 500 is locked into engagement with the retention and release assembly 400, in the manner disclosed herein. This locking may be indicated by the loss of the ability of the user to continue to rotate the boot interface portion 500 relative to the retention and release assembly 300. As well, locking may also be indicated by a click sound from the binding 300 and/or other feedback that can be perceived by one of the senses of the user. In FIG. 5*d*, the binding 300 is once again in the riding state indicated in the first view of FIG. 5*a*. It should be noted that the user can reengage the boot interface portion 500 with the retention and release assembly 400 prior to riding without any use of a remote control. That is, the remote control may only be needed for release of the snowboard 200.

F. Example Remote Release Control System

Figure 6:
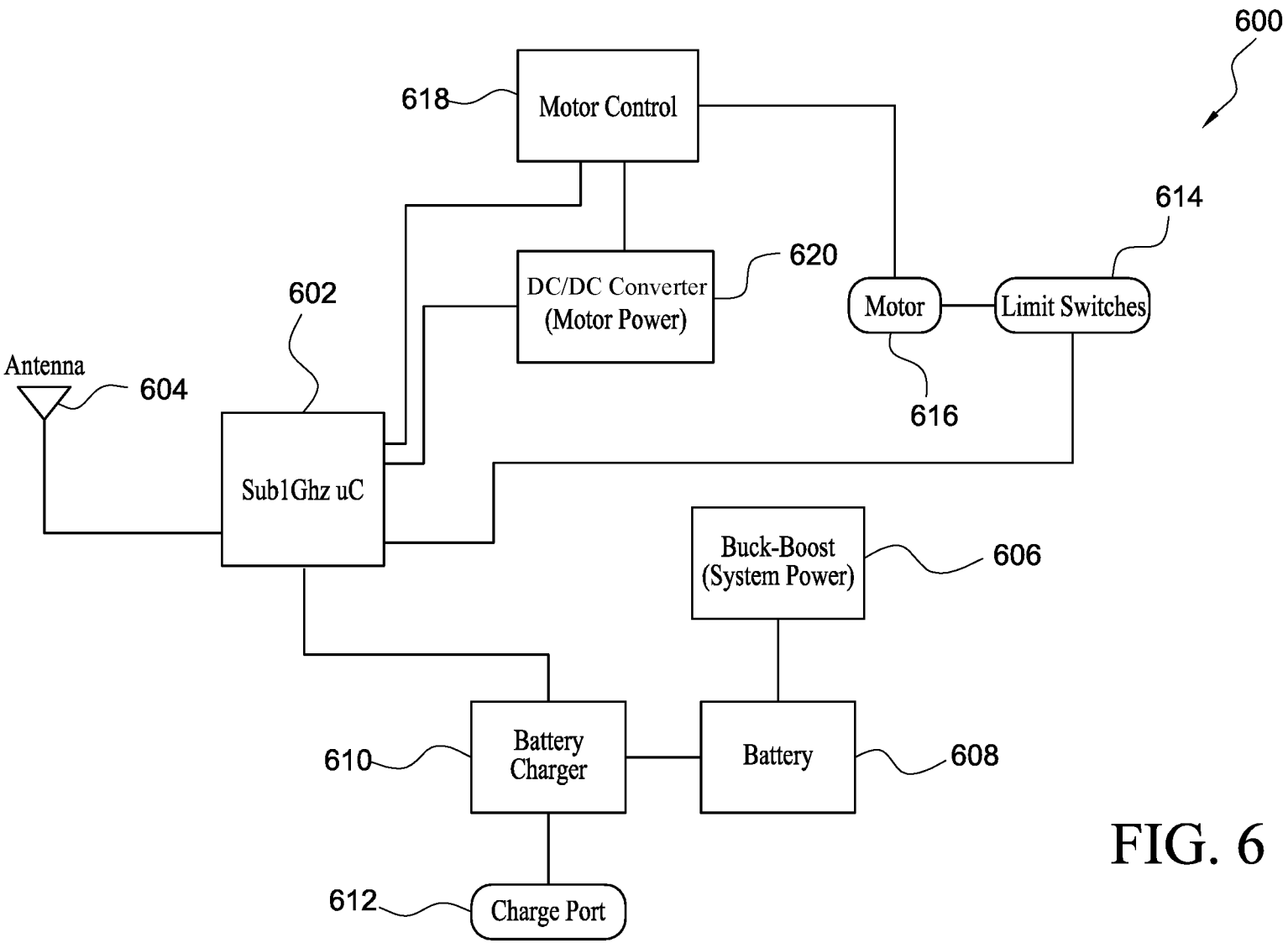
FIG. 6 is a block wiring diagram of an example control system.

With attention now to FIG. 6, further details are provided concerning aspects of a control system for remote release of a toe piece. One example embodiment of a control system, briefly noted above, is denoted at 600. The control system 600 includes a microcontroller 602, one example of which is a microcontroller (uC) from the Texas Instruments CC26xx and CC13xx family of cost-effective, ultralow power, 2.4-GHz and sub-1-GHz RF devices. Very low active radio frequency (RF), microcontroller current, and low-power mode current consumption provide excellent battery lifetime and allow operation of the microcontroller 602 on small coin-cell batteries, and in energy-harvesting applications.

The CC1310 device is a Sub-1-GHz device of cost-effective, ultralow power wireless microcontrollers. The CC1310 device combines a flexible, very low power RF transceiver with a powerful 48-MHz Cortex-M3 microcontroller in a platform supporting multiple physical layers and RF standards. As well, a dedicated radio controller (Cortex-M0) handles low-level RF protocol commands that are stored in ROM or RAM, thus ensuring ultralow power and flexibility. The CC1310 device has excellent sensitivity and robustness (selectivity and blocking) performance. The CC1310 device is a highly integrated, true single-chip solution incorporating a complete RF system and an on-chip DC-DC converter. Sensors can be handled in a very low-power manner by a dedicated autonomous ultralow power microcontroller that can be configured to handle analog and digital sensors. Thus, the main microcontroller (Cortex-M3) is able to maximize sleep time. The CC1310 power and clock management and radio systems require specific configuration and handling by software to operate correctly. This has been implemented in the TI microcontroller operating system (RTOS), which may be used for all application development on the microcontroller 602.

With continued reference to FIG. 6, the control system 600 includes an antenna 604 configured for wireless communication with a remote control device (not shown). In at least some embodiments, the antenna 604 is a low profile 866 Mhz antenna. However, other RF antenna configurations are enabled by use of the microcontroller 602, such as 433 Mhz and 915 Mhz configurations for example. Still other antenna 604 configurations include a Bluetooth version, and a dual band version.

The control system 600 further includes a buck-boost converter 606 which is operable to supply a fixed regulated voltage required for the control system 600, whether the control system is digital or analog. The buck-boost controller integrated circuit input voltage is taken from any power source that is able to operate over a wide range of voltages, such as those supplied by a chemical battery for example.

The power source 608 for the control system 600 may be a battery, such as a chemical based lithium-ion battery for example. All electrical/electronic systems on the remote release binding are powered by the battery 608. Other power sources may alternatively be used however, as can other battery chemistries. As well, super capacitors can be used to supply part or all of the power needed by the control system 600.

The control system 600 further includes a battery charger 610 having an associated charging port 612. In some embodiments, the battery charger 610 takes the form of the MikroElektronika MCP73871 device (PID: MIKROE-2858), which is a fully integrated linear solution for system load sharing and Li-Ion/Li-Polymer battery charge management with AC-DC wall adapter and USB port power source selection. The battery charger 610 is also capable of autonomous power source selection between an external input and the battery 608. Along with its relatively small physical size, the low number of required external components makes the MCP73871 device ideally suited for portable applications. As such, the battery charger 610 is well suited for use with the remote release snowboard binding embodiments disclosed herein.

As disclosed elsewhere herein, the control system 600 includes a limit switch 614 (denoted at 464 in FIG. 4*a*). The limit switch 614 is a mechanical limit switch that, in general, senses the home position and release position of the retention and release assembly (see, e.g., FIG. 4*a*). The limit switch 614 operates in conjunction with a motor 616 (denoted at 454 in FIG. 4*a*) that is controlled by a motor control circuit 618. In some embodiments, the motor control circuit 618 comprises an integrated H-Bridge configuration, although other suitable configurations could be used. Also, in order to accurately control the motor 616 and associated torque as part of a closed loop feedback system, the microcontroller 602 may generate pulse width modulation (PWM) or various duty cycles and frequencies that are used for speed and torque control of the motor 616.

Finally, the example control system 600 includes a DC/DC converter 620 (motor power). In order to drive the motor 616 with an adequate amount of torque, the DC/DC converter 620 is used to boost the battery 608 voltage to the voltage needed to drive the motor 616.

G. Example Remote Control Devices

Figure 7:
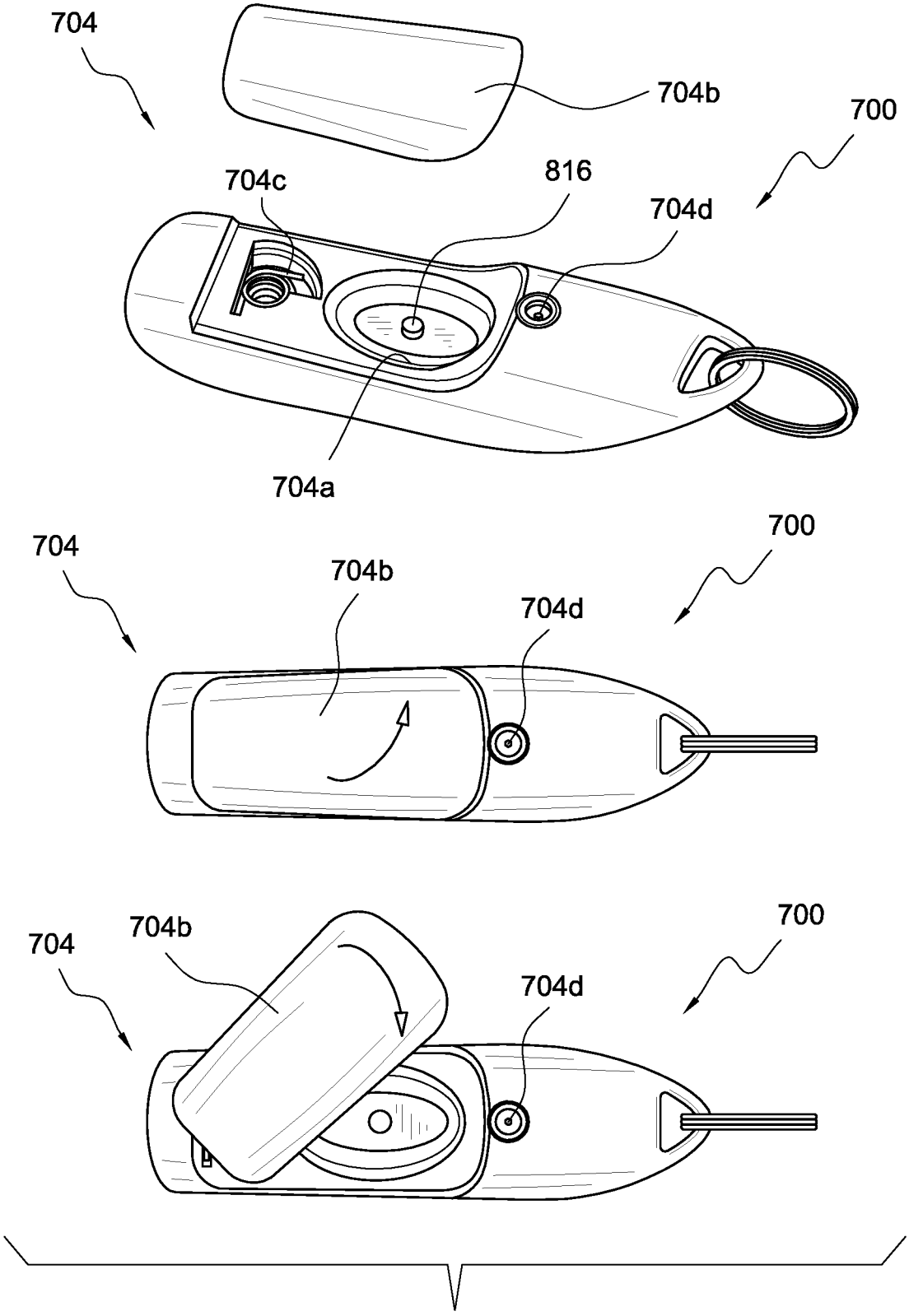
FIG. 7 discloses an example of a key fob configured to house a remote control system.
Figure 8:
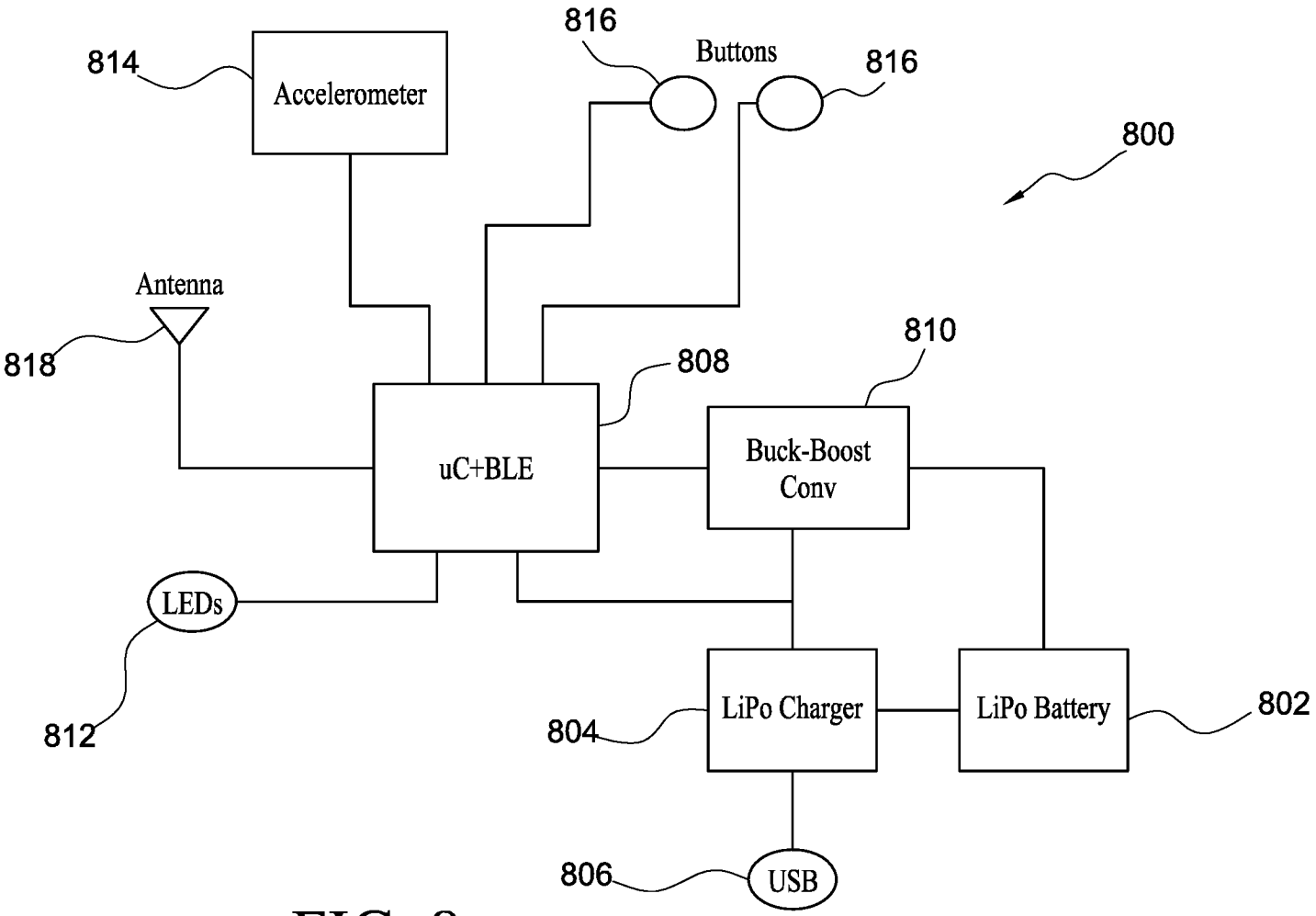
FIG. 8 is a block wiring diagram of an example remote control system.
Figure 9:
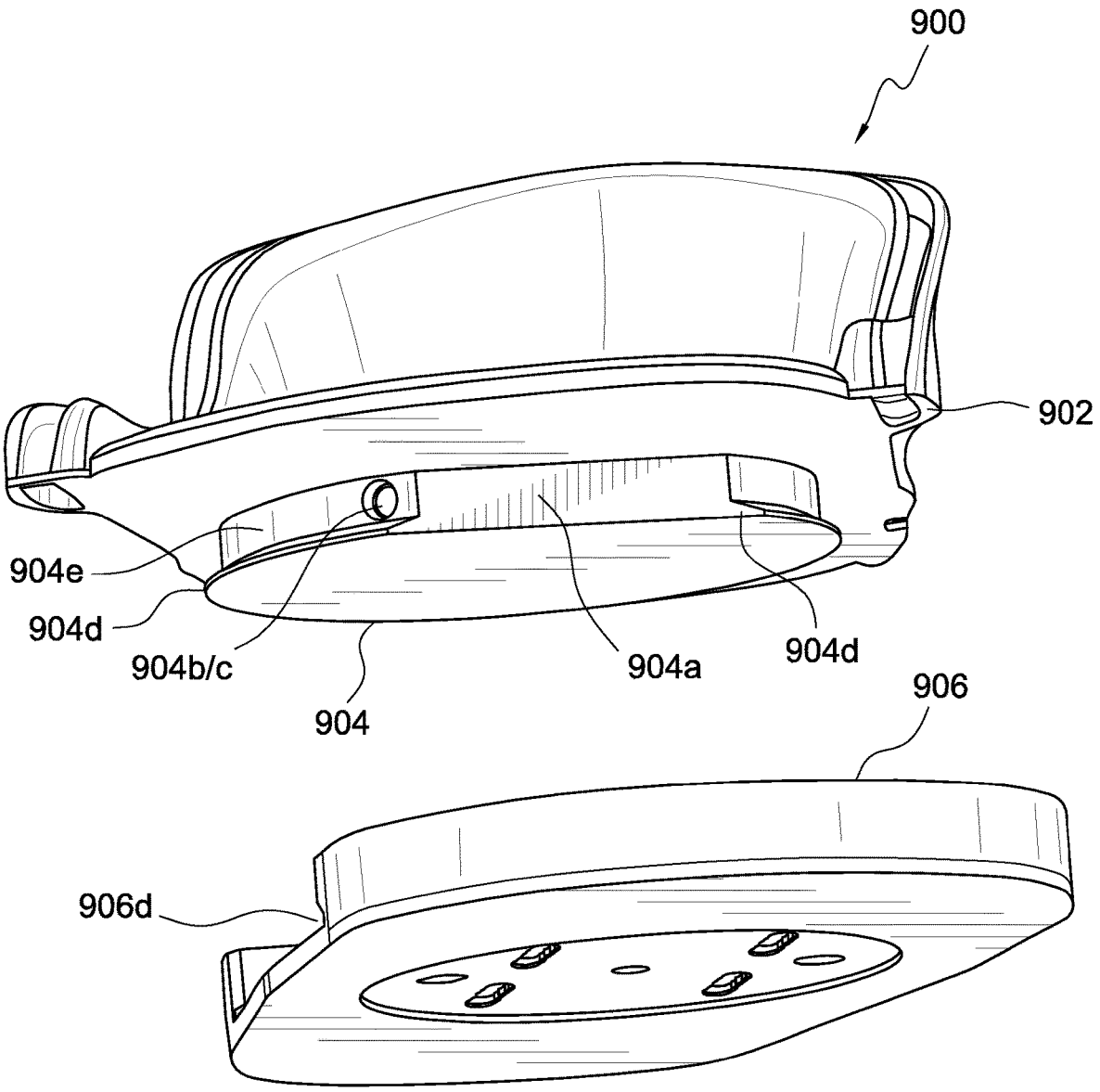
FIGS. 9-12 are directed to an alternative embodiment of a remote release snowboard binding.
Figure 10:
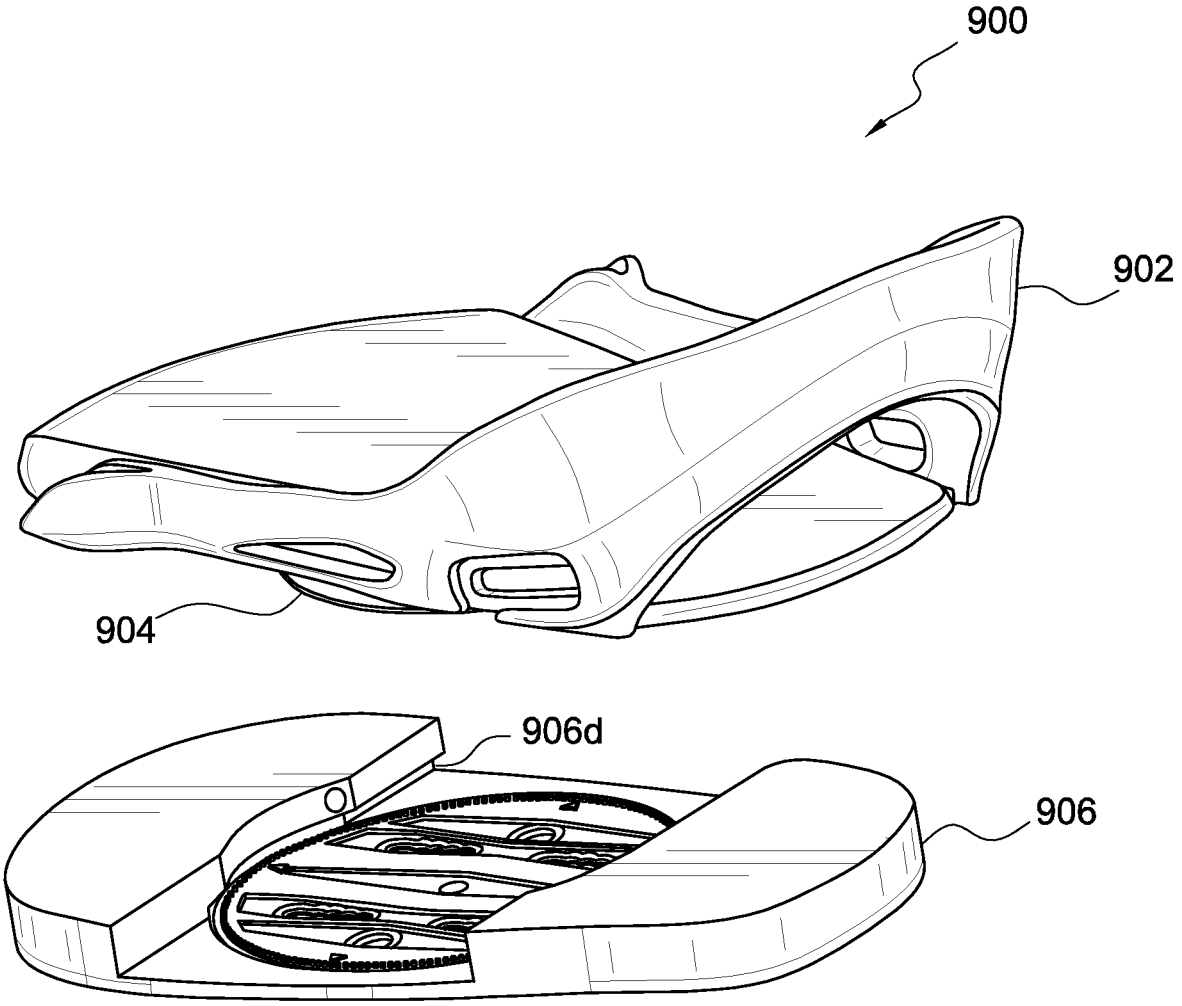
Figure 11:
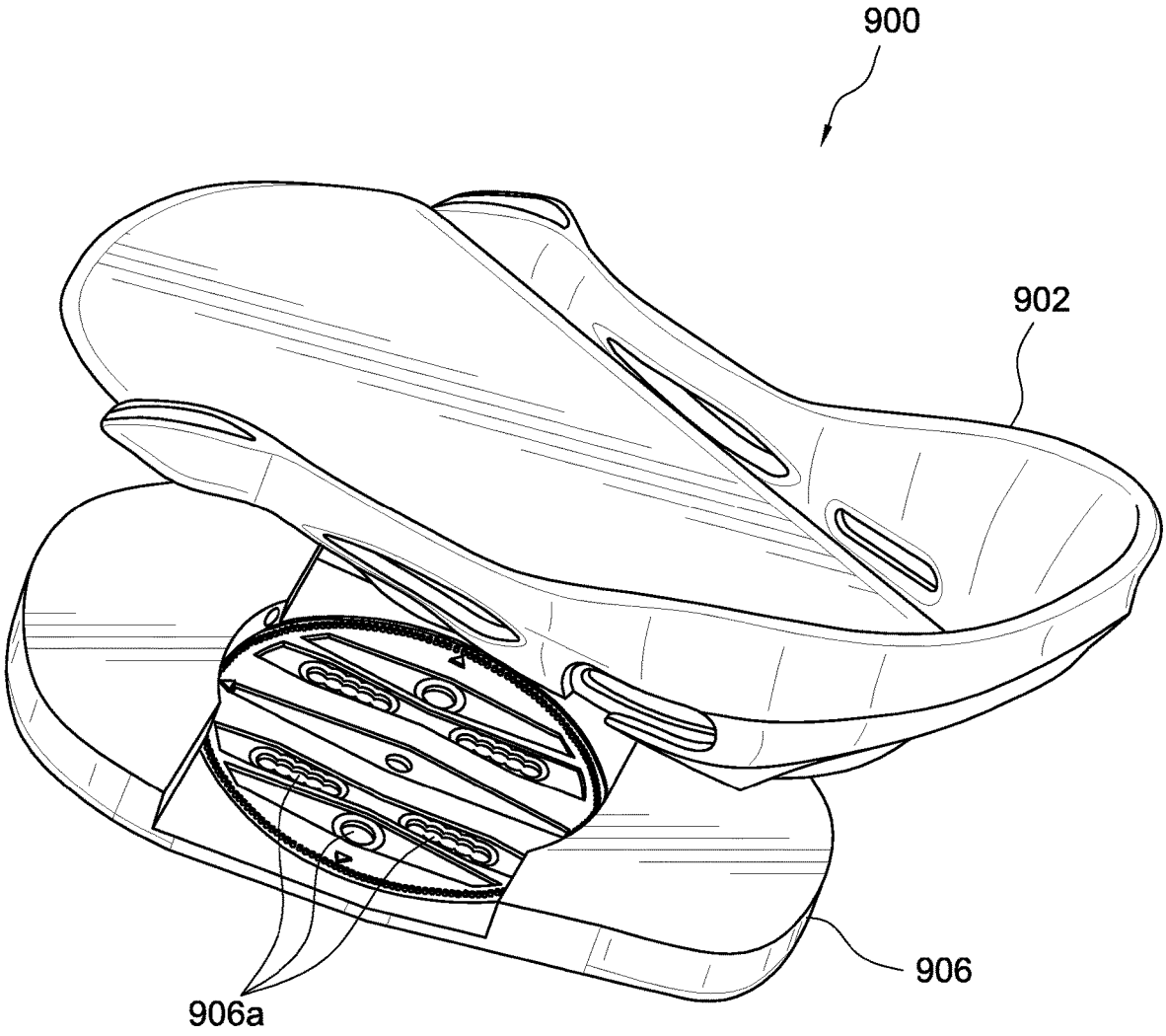
Figure 12:
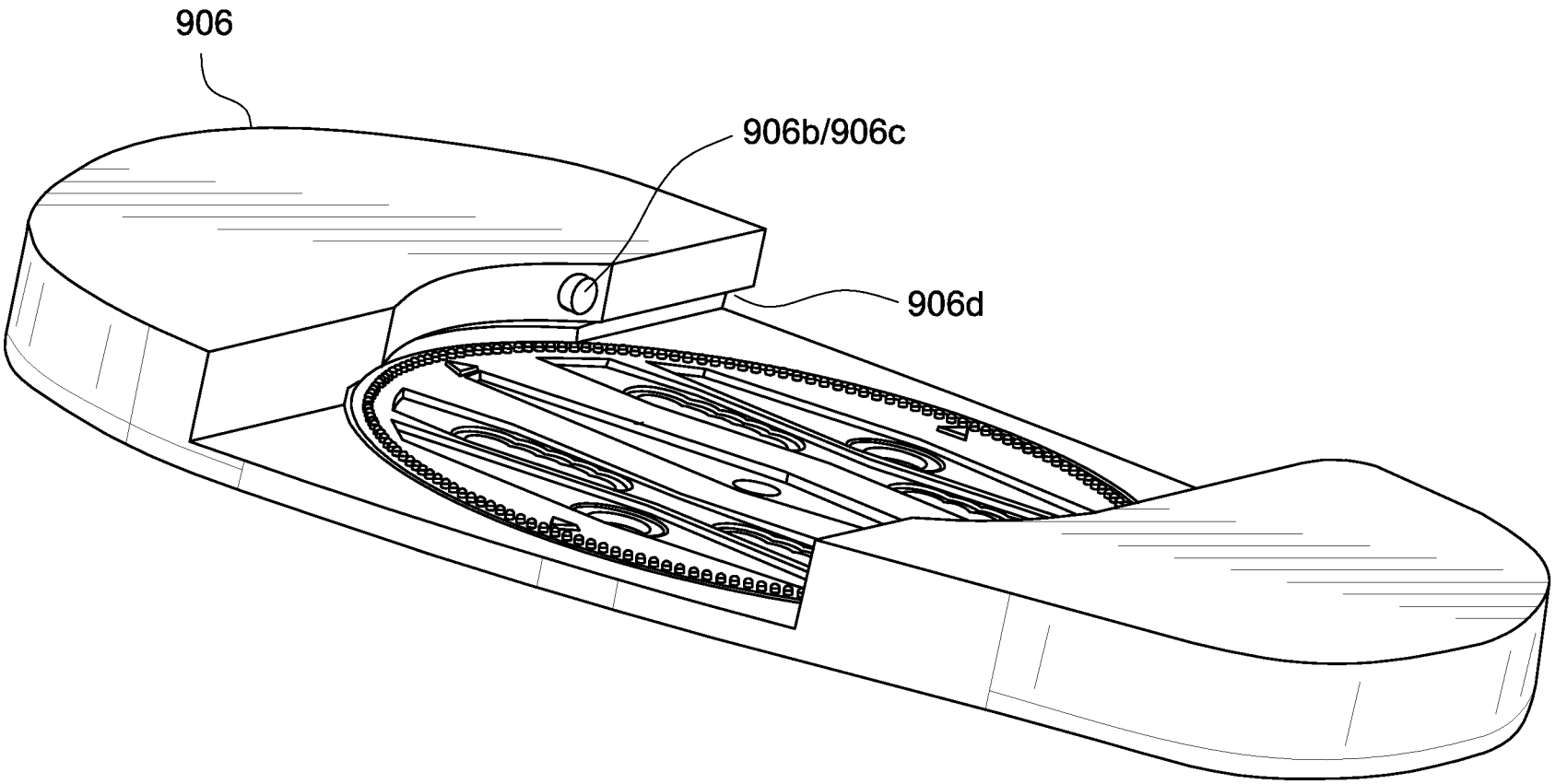

Directing attention now to FIGS. 7 and 8, details are provided concerning some example devices that a user can employ to remotely activate the retention and release assembly 400, thereby enabling the user to rotate the boot interface portion 500 and slide the boot interface portion 500 out of engagement with the retention and release assembly 400. In general, the circuitry employed to remotely activate the retention and release assembly 400 can be incorporated into any device desired by a user and, as such, those devices are generally referred to herein as remote control devices. As discussed below, examples of such devices can include, but are not limited to, a key fob or similar device.

In general, embodiments of the remote control device 700 and retention and release assembly 400 can communicate wirelessly with each other using any suitable wireless communication protocol or standard. In some embodiments, communication between the remote control device 700 and the retention and release assembly 400 can use radio frequency (RF) communication, or Bluetooth® technology and specifications, such as the Bluetooth Low Energy (BLE)

standard for example. In at least some embodiments, the retention and release assembly 400 and the remote control system 800 operate in a client-server/peripheral (respectively) relationship. Embodiments of the remote control system 800 can be operated on the initiative of the user such that the user can activate the retention and release assembly 400 to release the boot interface portion 500 from the retention and release assembly 400 at any time that the user desires.

In at least some embodiments, activation of the wireless communication between the remote control device 700 and the retention and release assembly 400 can be implemented by way of an application ("App"), such as a smartphone App for example. Thus, when a device including the App, such as a smartphone or other device, pairs with the retention and release assembly 400, the user can use the App to control the operation of the retention and release assembly 400. Correspondingly, the smartphone and/or processors and devices can be configured to communicate using wireless communication protocols, such as the IEEE 802.11X protocols, or the Bluetooth protocol.

Turning now to FIG. 7 in particular, details are provided concerning aspects of example remote controls, one particular example of which is located on a key fob that is denoted generally at 700 and houses a remote control system 800. In terms of its overall configuration, the key fob 700 can be of conventional construction and, as such, may include a body 704. In this particular example however, the body 704 defines a recess 704*a* within which some or all components of a remote control system 800 (see FIG. 8) are disposed, such as an activation button 816. The body 704 can additionally include a trap door 704*b* or other mechanism that can be selectively moved by the user. The trap door 704*b* can be a sliding or swinging door for example, and may be spring-loaded by a biasing element 704*c*, such as a spring for example, so as to be biased to a closed position. This location for the remote control system 800 is well suited to enable the user ready access to the remote control system 800 functions when needed, but is otherwise unobtrusive and does not interfere with the operation of the key fob 700. The body 704 may also include a charging port 704*d* that enables the remote control circuitry (not shown) to be connected to a charging source. The trap door 704*b* and/or the body 704 may include a gasket or other sealing element to help prevent the ingress of snow, ice, water, and dirt into the recess 704*a* when the trap door 704*b* is closed.

In operation, the user can move, such as by rotating, the trap door 704*b* against the bias imposed by the biasing element 704*c* to the position shown in FIG. 7 so that the user can access the remote control system 800. When the remote control system 800 is not in use, the trap door 704*b* can be moved by the user, or automatically by operation of the biasing element 704*c*, to a position where the remote control system 800 is inaccessible. Among other things then, the trap door 704*b* can help to avoid inadvertent activation of any of the functions of the remote control system 800. In at least some embodiments, the trap door 704*b*, recess 704*a*, and/or the body 704, include a seal, such as a gasket or O-ring for example, that helps to keep snow, water and ice from entering the recess 704*a*. In at least some embodiments, the remote control system 800 includes sealed buttons (see FIG. 8), such as rubber buttons, that allow the user to operate the remote control system 800 notwithstanding the presence of snow, water and/or ice in the recess 704*a*.

With reference finally to FIG. 8, details are provided concerning the circuitry and operation of an example remote control system 800. The remote control system 800 includes a power source 802 which can be a replaceable battery, such as a CR2032 battery for example, in some embodiments, such as when the remote control system 800 is included in a key fob or similar device. In other embodiments, such as when the remote control system 800 is included in the key fob 700, power can be supplied from a single rechargeable Li-polymer battery. When this battery 802 is fully charged, it may provide 4.2 Vdc.

In embodiments that employ a rechargeable battery, a controller 804 may be provided that can be accessed by a charging port 806, which can be a USB connection, for example. The controller 804 can be an LiPo controller in the form of a stand-alone system load sharing and Li-Ion/Li-Polymer battery charge management controller. This control block employs a constant current/constant voltage (CC/CV) charge algorithm with selectable charge termination point. As well, the LiPo controller provides LiPo battery status to a micro-controller 808. The micro-controller (uCBLE) 808 can include a single micro-controller and Blue Tooth Low Energy and has a System On Chip (SOC) configuration. Finally, the LiPo controller 804 is supplied charge current or power from the charging port 806.

The remote control system 800 can additionally include a buck-boost converter 810 that produces a DC output of 3.3 V. The output voltage magnitude is either greater than or less than the input voltage magnitude which is supplied from the power source 802. This supplies a regulated 3.3 Vdc to the microcontroller 808 and other support circuitry. The buck-boost converter 810 can be omitted in embodiments that do not use a rechargeable battery as a power source.

In the example of FIG. 8, the remote control system 800 also includes one or more light sources 812. In some embodiments, the light source(s) 812 take the form of light emitting diodes (LED), and can emit light of any color. The light sources 812 may be used to provide visual indication to a user concerning, for example, battery low condition, and low radiated signal strength (RSSI).

In some embodiments of the remote control system 800, such as where the remote control system 800 is included in a fob for example, an accelerometer 814 is provided that interfaces with the microcontroller 808 via a two wire interface (TWI). The accelerometer 814 enables a user to initiate various functions simply by tapping the fob, or other device, a certain number of times. For example, tapping the buttons 816 of the fob 700 a programmed number of times produces an input to the accelerometer 814 which is then used to initiate the boot interface portion release function. In this particular example, a hand held fob may have a single button 816, which can be used to activate the boot interface release function.

Finally, and as suggested earlier, the remote control system 800, regardless of whether it is employed in a hand-held device such as a fob, or in a key fob 700, may include one or more antennas 818. In general, the antennas 818 enable wireless communication between the remote control system 800 and a corresponding retention and release assembly.

H. Alternative Embodiments

Directing attention now to FIGS. 9-12, details are provided concerning an example alternative embodiment of a remote release snowboard binding, designated generally at 900. In general, the components, configuration, and principles of operation, of the embodiment in FIGS. 9-12 may be similar, or identical, to those of the other embodiments disclosed herein. As such, the following discussion is primarily directed to selected differences between the embodiments.

The snowboard binding 900 includes a boot interface portion 902 to which a retention and release assembly 904 is attached. The retention and release assembly 904 includes a housing 904*a* that is configured to releasably engage a baseplate 906 which is attachable to a snowboard (not shown). The baseplate 906 may include various openings 906*a*, such as holes, slots, and/or grooves, to enable the attachment of the baseplate to a snowboard. The baseplate 906 also includes a pin 906*b* that is at least partly disposed in an associated bore 906*c*. More specifically, the pin 906*b* is biased by a biasing element (not shown), such as a spring for example, which causes the pin 906*b* to protrude out of the bore 906*c*. As shown, the pin 906*b* may be chamfered at its terminal end.

The housing 904*a* includes a bore 904*b* in which a plunger 904*c* is disposed for reciprocal motion, similar to the plunger 452/bore 418 arrangement disclosed elsewhere herein. The configuration and operation of the plunger 904*c* and bore 904*b* may be similar, or identical, to that of the plunger 452 and bore 418, respectively. Thus, for example, some or all of the components of the retention and release assembly 400 may be employed in connection with the plunger 904*c*.

In operation, the boot of the user is releasably retained in the boot interface portion 902 and the user can then place the boot interface portion 902 onto the baseplate 906 so that the flange 904*d* is positioned in the undercut 906*d* defined by the baseplate 906. The flange 904*d*/undercut 906*d* arrangement helps to retain the boot interface portion 902 from pulling out of the baseplate 906. Once the boot interface portion 902 is correctly positioned relative to the baseplate 906, the user can rotate the boot interface portion 902 until the protruding pin 906*b* of the baseplate 906 is received in the bore 904*b* of the housing 904. The chamfered end of the pin 906*b* enables the housing 904*a* to rotate into position without catching on the pin 906*b*. When the pin 906*b* is received in the bore 904*b*, the boot interface portion 902 is locked in position and the user is ready to ride. Further, when the pin 906*b* is received in the bore 904*b*, the terminal end of the pin 906*b* may be positioned near, or may be in contact with, a terminal end of the plunger 904*c*.

When the user wants to disengage from the snowboard, the user can operate the remote control, which causes the plunger 904*c* to move within the bore 904*b*, specifically, pushing the pin 906*b* out of the bore 904*b* until the terminal end of the plunger 904*c* is flush, or nearly so, with the outer wall 904*e* of the housing 904. As a result of this motion of the plunger 904*c*, the pin 906*b* is moved out of the bore 904*b* and the housing 904 is once again free to rotate relative to the baseplate 906. The user can then rotate the boot interface portion 902 relative to the baseplate 906, and then remove the boot interface portion 902 from the baseplate 906.

I. Aspects of Still Other Alternative Embodiments

With attention now to FIGS. 13*a*-13*e*, FIGS. 14*a*-14*e*, and FIG. 15, details are provided concerning some alternative embodiments of a snowboard binding with a mechanical retention and release assembly that is manually operable by a user. The mechanical retention and release assembly can be employed in a snowboard binding as the sole mechanism by way of which a user can release himself from a snowboard. In an alternative configuration, the mechanical retention and release assembly may be configured so that it can be operated manually by the user, as well as remotely by the user as disclosed elsewhere herein. This latter configuration may be useful, for example, in case the remote actuation functionality should fail for some reason. The user could then release the snowboard binding manually. Thus, the mechanical release function serves as a backup to the remote release function. Except as noted in the following discussion, the embodiments disclosed in FIGS. 13*a*-13*e*, and FIGS. 14*a*-14*e*, may be similar, or identical, to one or more of the other embodiments disclosed herein.

With attention first to FIGS. 13*a*-13*e*, the example snowboard binding is designated generally at 1000 and includes a cable 1002 connected to a release handle 1004 that may be T-shaped, or have any other suitable configuration that enables a user to quickly and securely grasp the release handle 1004. In some embodiments, the handle 1004 may be integral with an element of a boot interface portion 1006.

In general, the cable 1002 can be routed in any suitable manner that tends to prevent interference between the cable 1002 and other components of the snowboard binding 1000. As well, the cable 1002 should be routed in such a way that it is not unduly exposed to damage or impacts. Further, it may be desirable to make the cable 1002 run as short as possible, while still providing the necessary functionality.

Thus, in the example embodiment of FIGS. 13*a*-13*e*, a significant portion of the cable 1002 is routed within the structure of the boot interface portion 1006, specifically the sole 1008. Any other suitable cable 1002 routing may be employed however. While not specifically shown in the Figures, the proximal portion 1002*a* of the cable 1002 and the handle 1004 may, for example, be connected on, or near, an upper portion of the boot interface portion 1006 so as to be conveniently located for manual user operation. Other locations for the proximal portion of the cable 1002 and the handle 1004 may alternatively be used. A distal portion 1002*b* of the cable 1002 is discussed below.

Figure 13A:
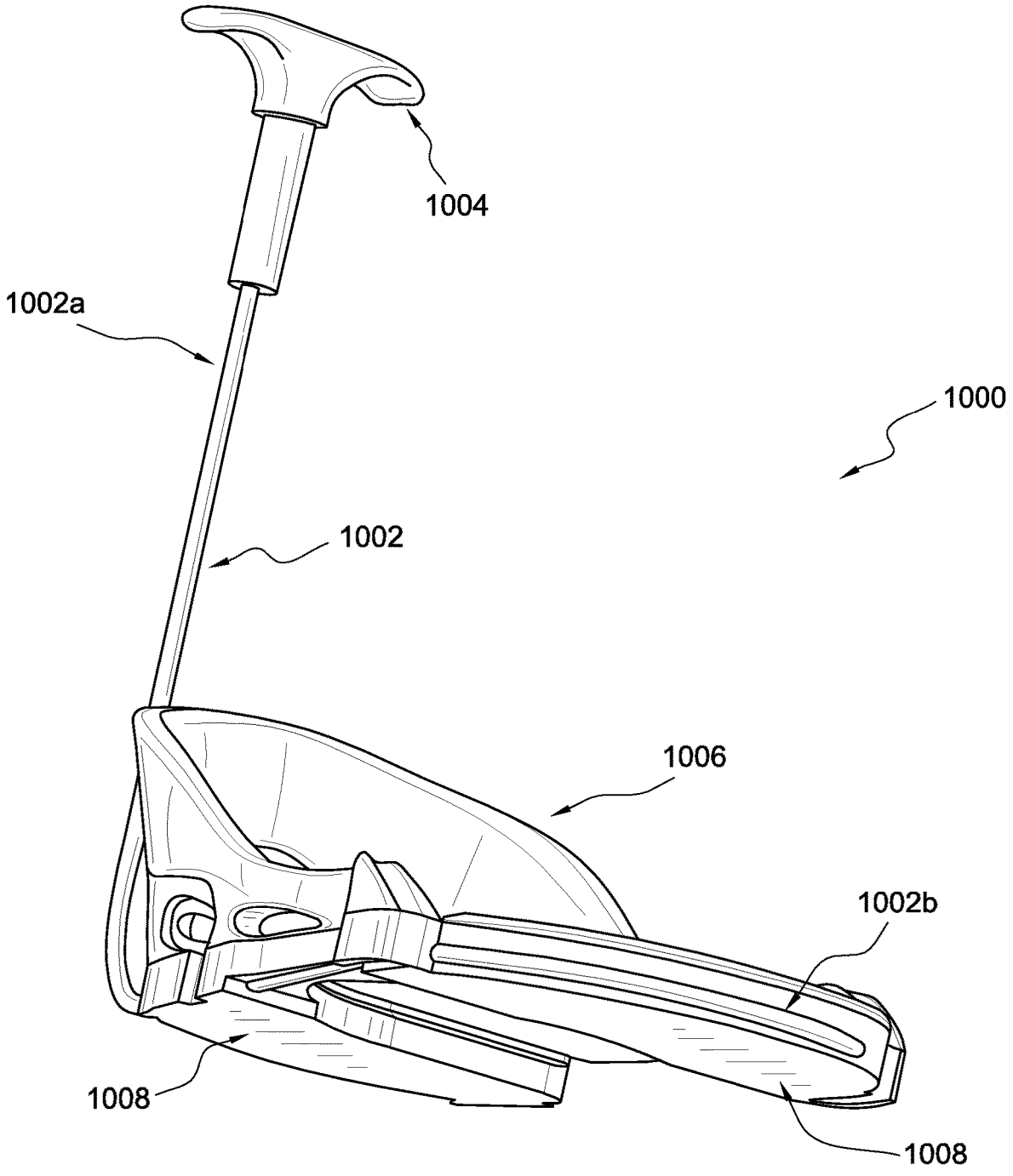
FIGS. 13*a*-13*e* are directed to a further alternative embodiment of a remote release snowboard binding.
Figure 13B:
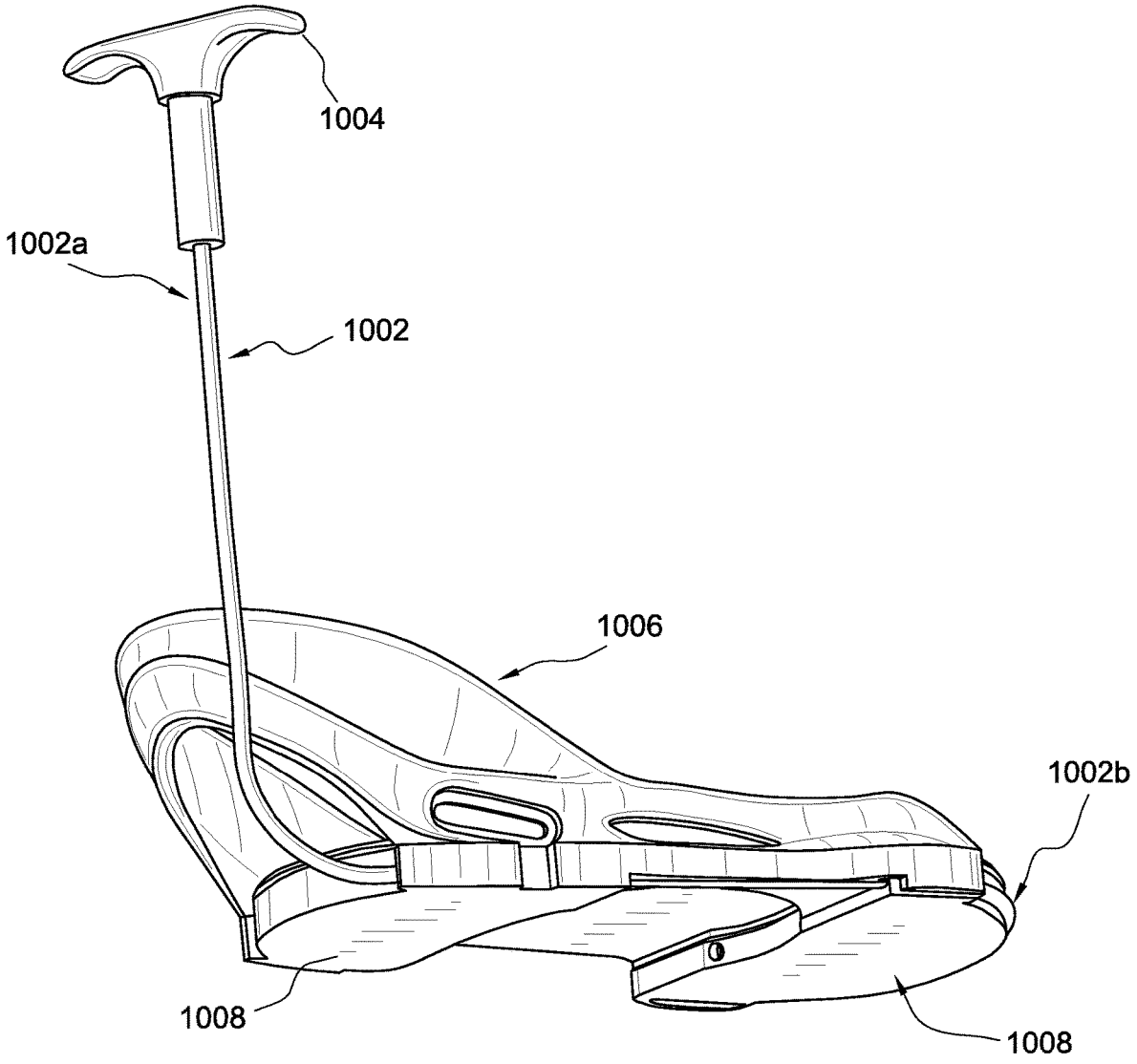
Figure 13C:
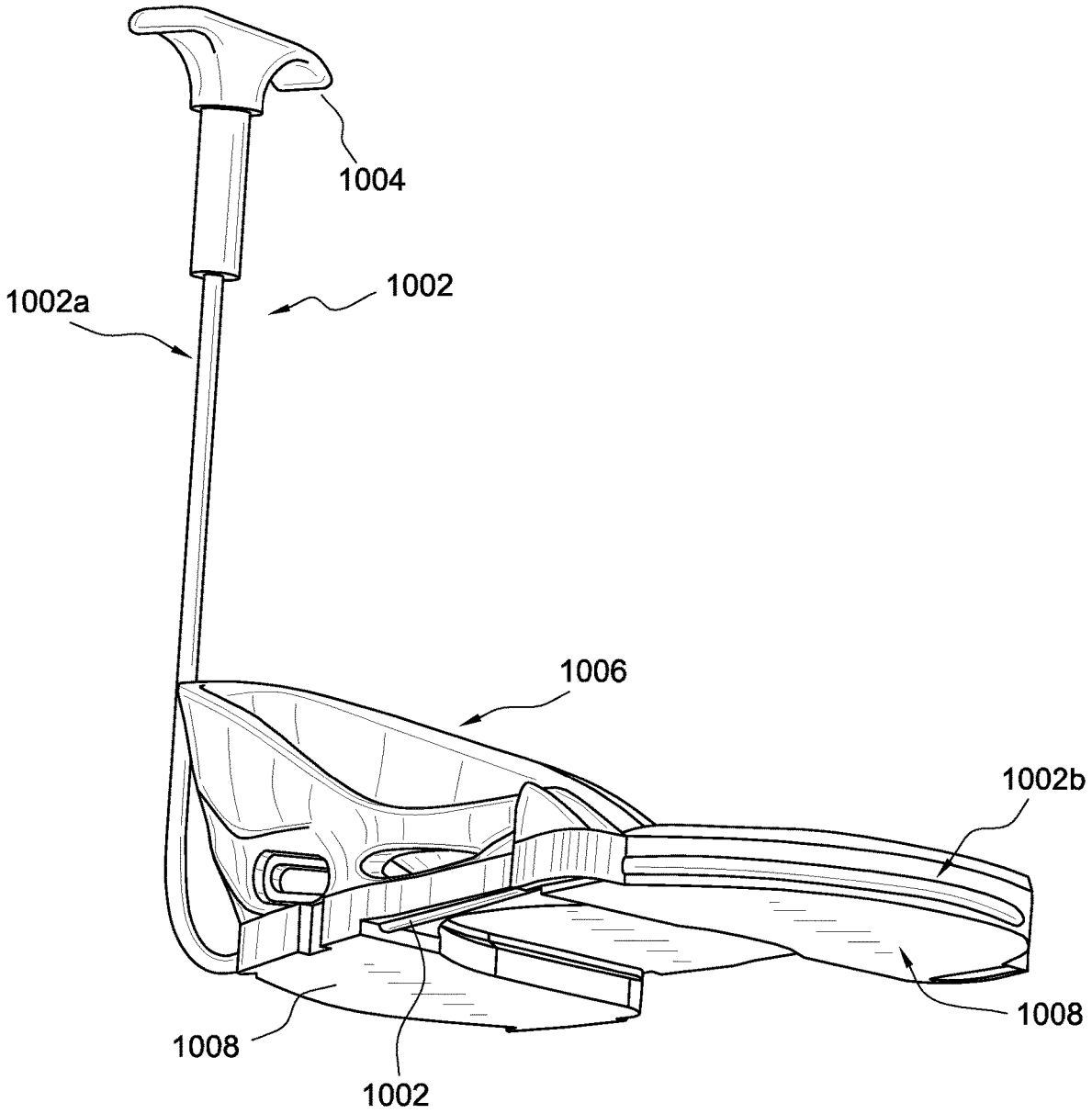
Figure 13D:
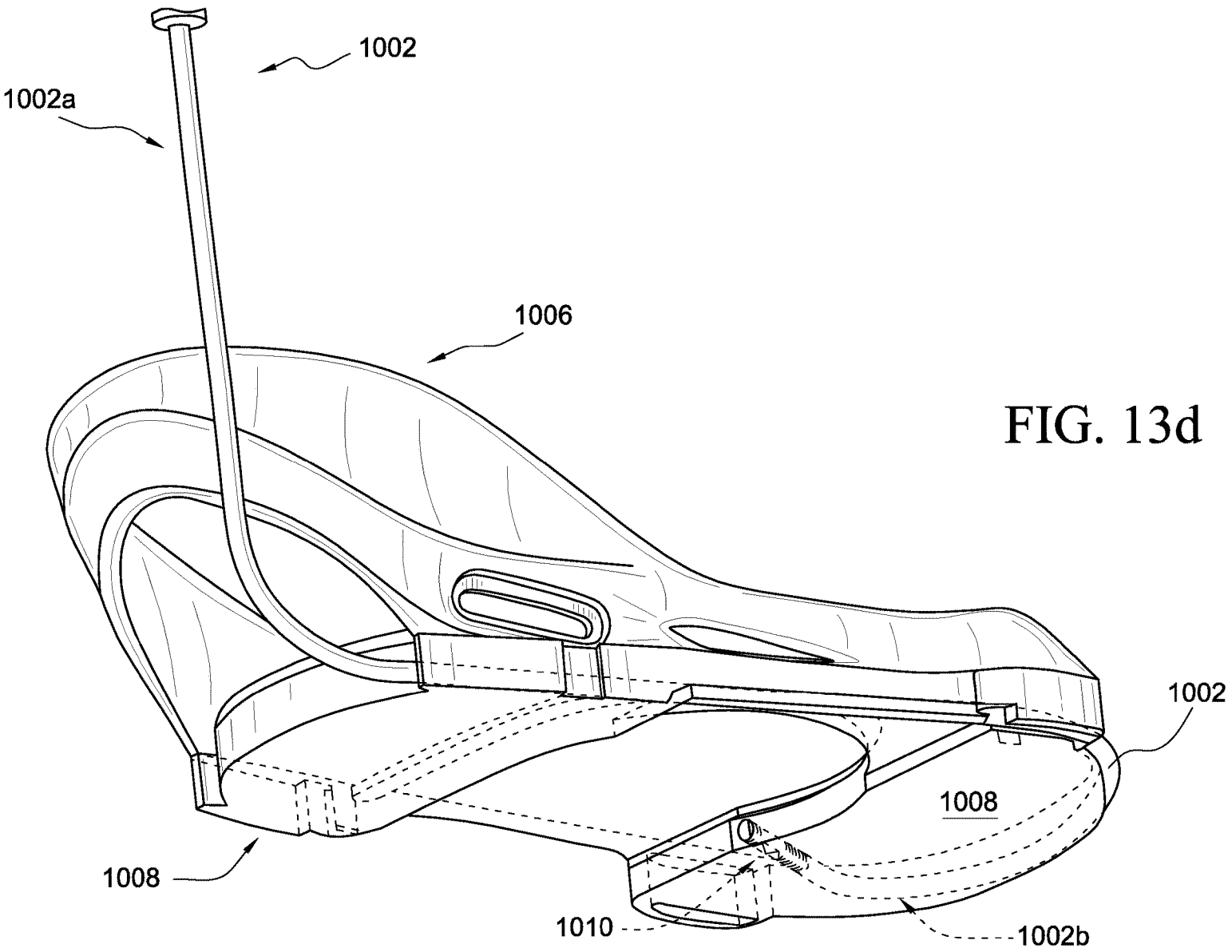
Figure 13E:
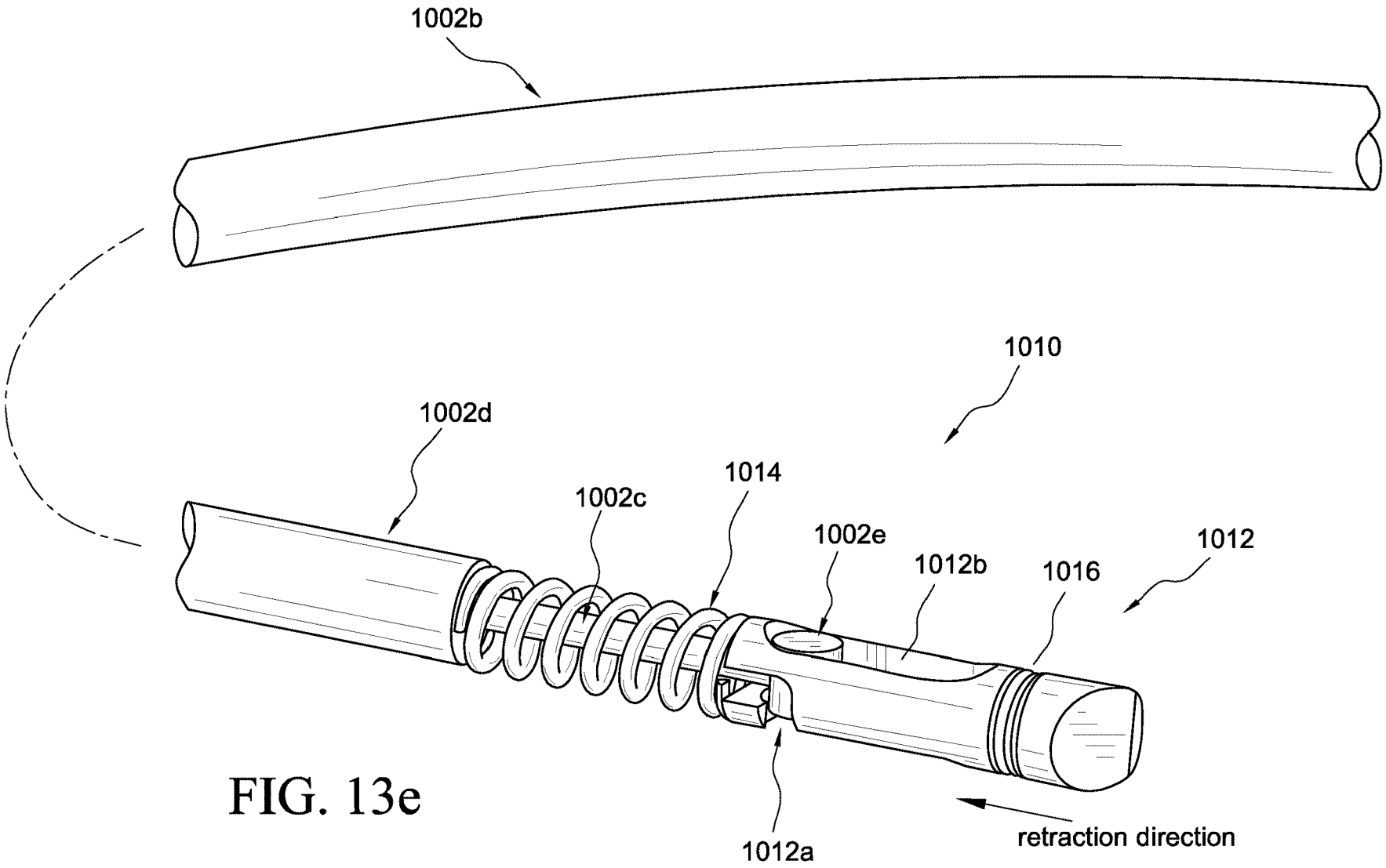

As generally indicated in FIG. 13*e* in particular, the cable 1002 may be connected to an actuator assembly 1010. In more detail, the cable 1002 includes a movable cable element 1002*c* slidably received within a protective sheath 1002*d*, and a terminal end 1002*e* of the cable element 1002*c* is releasably engaged with a pin 1012 that may be chamfered on the end, as shown. The pin 1012 defines a slot 1012*a* that is configured and arranged to enable the terminal end 1002*e* of the cable element 1002*c* to be positioned within, and removed from, another slot 1012*b* of the pin 1012. As shown, the slot 1012*b* is configured to have a length that allows for some free play of the terminal end 1002*e*, thereby enabling the pin 1012 to retract. As well, a spring 1014 disposed between the end of the protective sheath 1002*d* and the pin 1012 is configured and arranged so that the spring 1014 tends to resist movement of the pin 1012 in the retraction direction (see FIG. 13*e*).

With continued reference to FIG. 13*e*, the actuator assembly 1010 may include one or more O-rings or other sealing elements 1016 to provide a dynamic seal. That is, the sealing element(s) 1016 may collectively be of sufficient length to ensure that the pin 1012 remains sealed relative to the sole 1008, regardless of the position or movement of the pin 1012. While not specifically illustrated, one or more additional sealing elements may be provided on the protective sheath 1002*d* to provide a static seal between the protective sheath 1002*d* and the sole 1008. As well, one or more clamps (not shown) may be used to fix the position of the protective sheath 1002*d* relative to the sole 1008.

In operation, the pin 1012 is biased by the spring 1014 into a default extended position in which a portion of the pin 1012 is slidingly received in a corresponding bore (not shown) defined by housing of a retention and release assembly, such as the bore 904*b* of the housing 904*a*, for example. When the pin 1012 is so disposed, the boot interface portion 1006 is locked to the retention and release assembly.

The bias imposed by the spring 1014 can be overcome, and the boot interface portion 1006 released from the retention and release assembly (not shown), when the user pulls on the handle 1004 that is attached to the cable 1002, thereby retracting the pin 1012 from the aforementioned bore. When the pin 1012 has been retracted, the user can then rotate the boot interface portion 1006 and remove the boot interface portion 1006 from the retention and release assembly.

Thus, in this embodiment, there may be no need for a plunger in the bore or for any moving parts in the housing that defines the bore, since the pin 1012 is affirmatively retracted from the bore by the user, rather than being pushed out of the bore by a plunger as in some other embodiments disclosed herein. As such, where electronic remote control functionality is not provided in the snowboard binding 1000, the retention and release assembly may simply comprise, or consist of, a housing that defines a bore in which the pin 1012 is removably received. This housing may have the same, or similar, configuration as the housing 406, for example, and all moving parts may be omitted from the housing.

As noted above, the user can use the cable 1002 to retract the pin 1012 from a bore defined by a housing. Additionally, or alternatively, electronics, and a plunger, in the housing could be used to push pin 1012 out of the bore. One example of such a housing and associated mechanical and electrical components is disclosed in FIGS. 4*a*-4*c*.

When the user releases the handle 1004, the spring 1014 acts on the pin 1012 to return the pin 1012 to an extended position in which the pin 1012 is received in the bore of the retention and release assembly, once again locking the boot interface portion 1006 to the retention and release assembly (not shown). To reenter the snowboard binding 1000, the user does not need to pull the handle 1004. Rather, the user can simply reenter the snowboard binding 1000 in the same manner as described herein with respect to other embodiments of the invention.

With reference now to FIGS. 14*a*-14*e*, details are provided concerning another example embodiment of a snowboard binding, designated generally at 1100. Except as noted in the following discussion, the embodiment disclosed in FIGS. 14*a*-14*e*, may be similar, or identical, to one or more of the other embodiments disclosed herein, including the embodiment disclosed in FIGS. 13*a*-13*e*.

As shown, the snowboard binding 1100 may include a boot interface portion 1102 that includes a sole 1104 to which a housing 1106 is mounted. The housing 1106 may have a similar, or identical, size and configuration to any of the other housings disclosed herein, although that is not necessarily required. The snowboard binding 1100 also includes a cable (not shown) that may be connected to an actuator assembly 1110 in the same, or identical, configuration and manner as indicated in FIGS. 13*a*-13*e*.

As such, the actuator assembly 1110 includes a spring 1112 that acts on a pin 1114 that is slidingly received in a bore 1116 defined by the housing 1106. As in the case of other disclosed housing embodiments, the housing 1106 may be a single-piece construction and can be made of metals such as aluminum for example, composite materials, plastic, or other suitable materials.

With continued reference to the Figures, a baseplate 1118 is also provided that is configured to be attached to a snowboard. Example attachment configurations are disclosed elsewhere herein. The baseplate 1118 defines a bore 1120 configured to slidingly receive the pin 1114. In general, the baseplate 1118 interfaces with the housing 1106 in the same, or similar, manner as in the case of other disclosed embodiments. As such, the user may enter the snowboard binding 1100 by placing the housing 1106 onto the baseplate 1118 and rotating the boot interface portion 1102, to which the housing 1106 is attached, until the pin 1114, biased into an extended position by the spring 1112, is received in the bore 1120. At this point, the boot interface portion 1102 is locked onto the baseplate 1118. No operation or movement of the cable (not shown) is required to effect locking of the boot interface portion 1102 onto the baseplate 1118.

When the user pulls a handle (not shown) attached to the cable (not shown), the bias exerted by the spring 1112 on the pin 1114 is overcome, and the pin 1114 is retracted from the bore 1120 against the bias imposed by the spring 1112. While the pin 1114 is still retracted, the user can then rotate the boot interface portion 1102, to which the housing 1106 is attached, thereby disengaging the housing 1106 from the baseplate 1118. The user can then release the handle, freeing the spring 1112 to act on the pin 1114 so that the pin 1114 again assumes the extended position. To reenter the snowboard binding 1100, the user does not need to pull the handle. Rather, the user can simply reenter the snowboard binding 1100 in the same manner as described herein with respect to other embodiments of the invention.

Figure 14A:
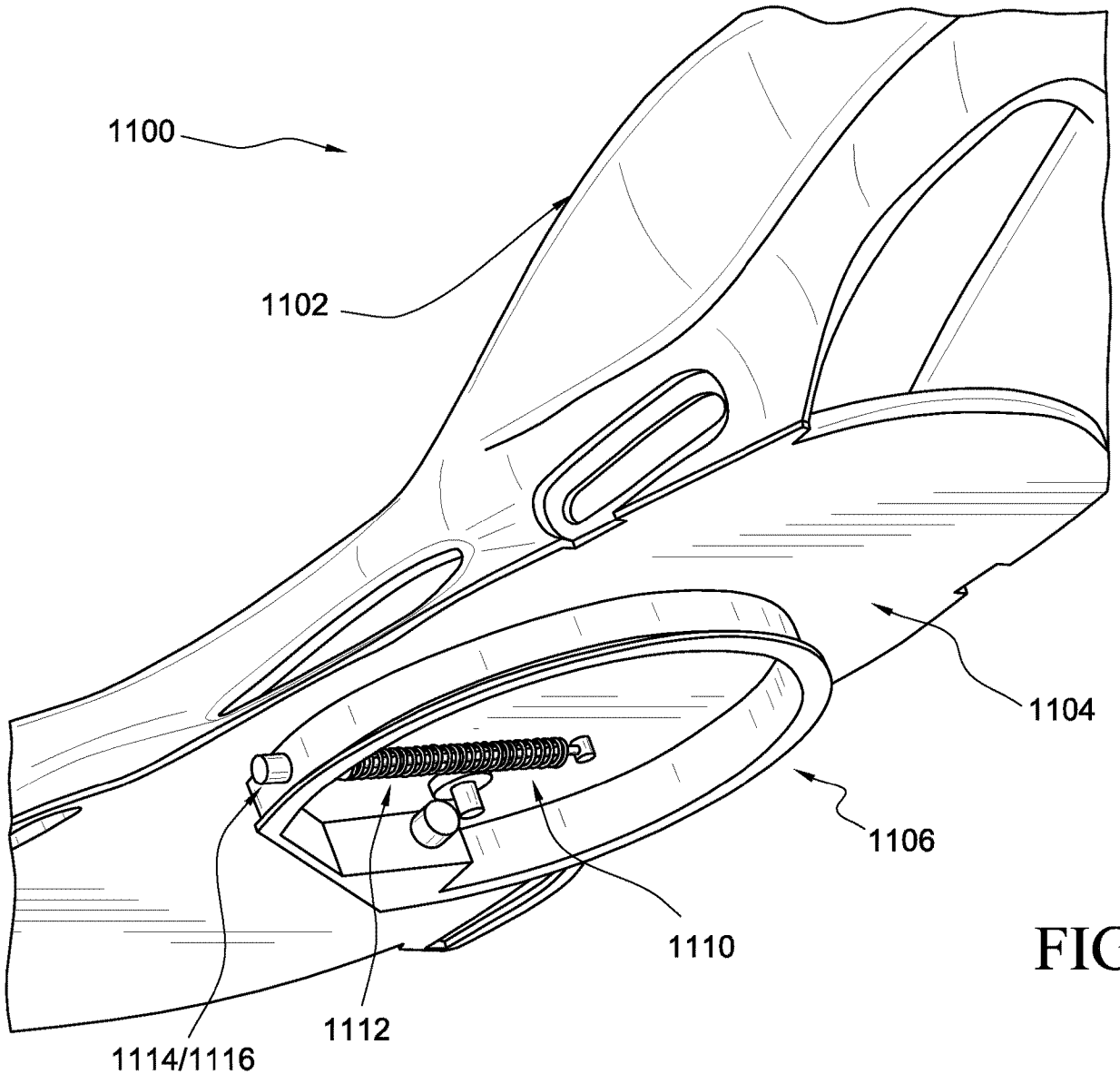
FIGS. 14*a*-14*e* are directed to another alternative embodiment of a remote release snowboard binding.
Figure 14B:
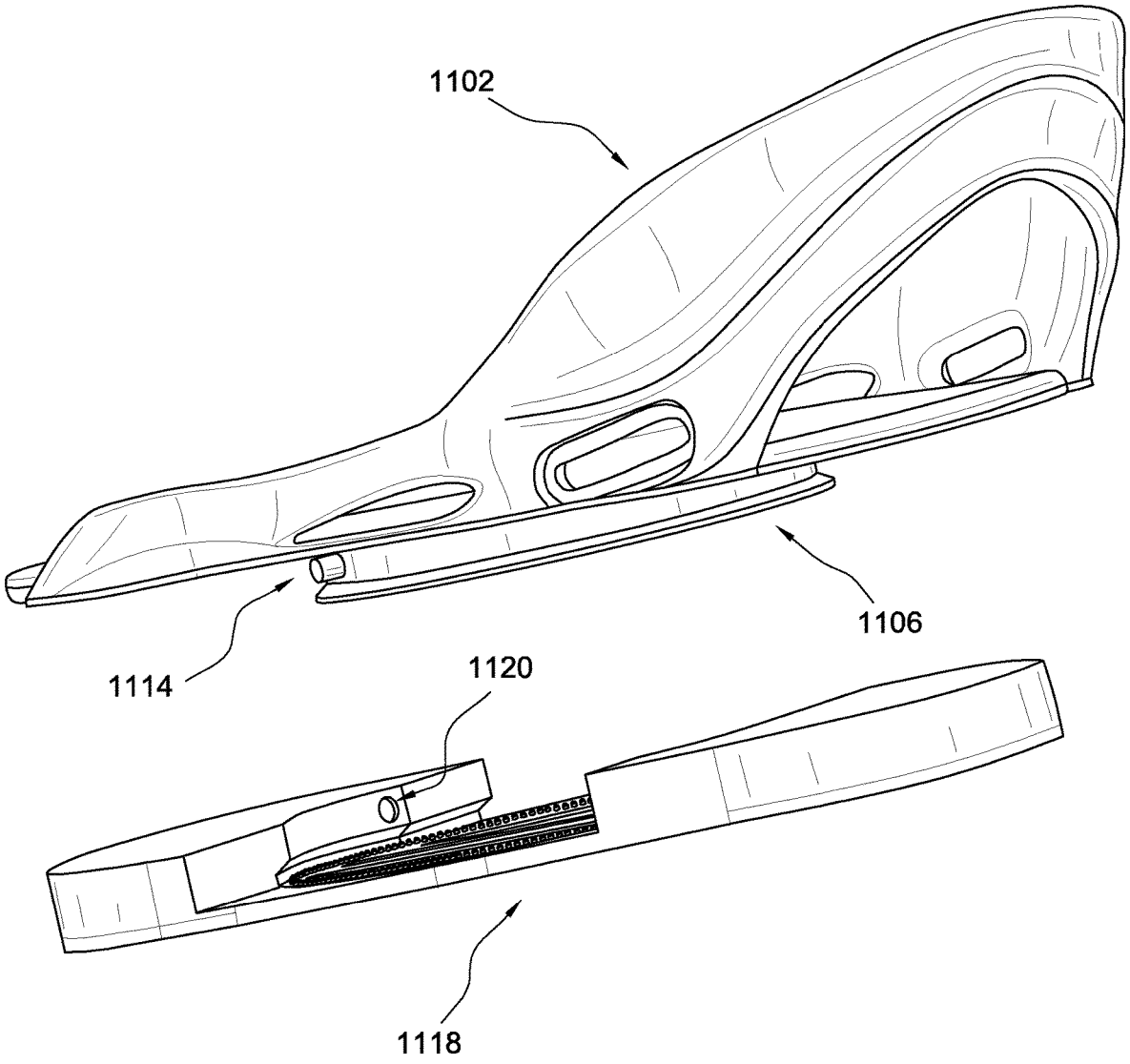
Figure 14C:
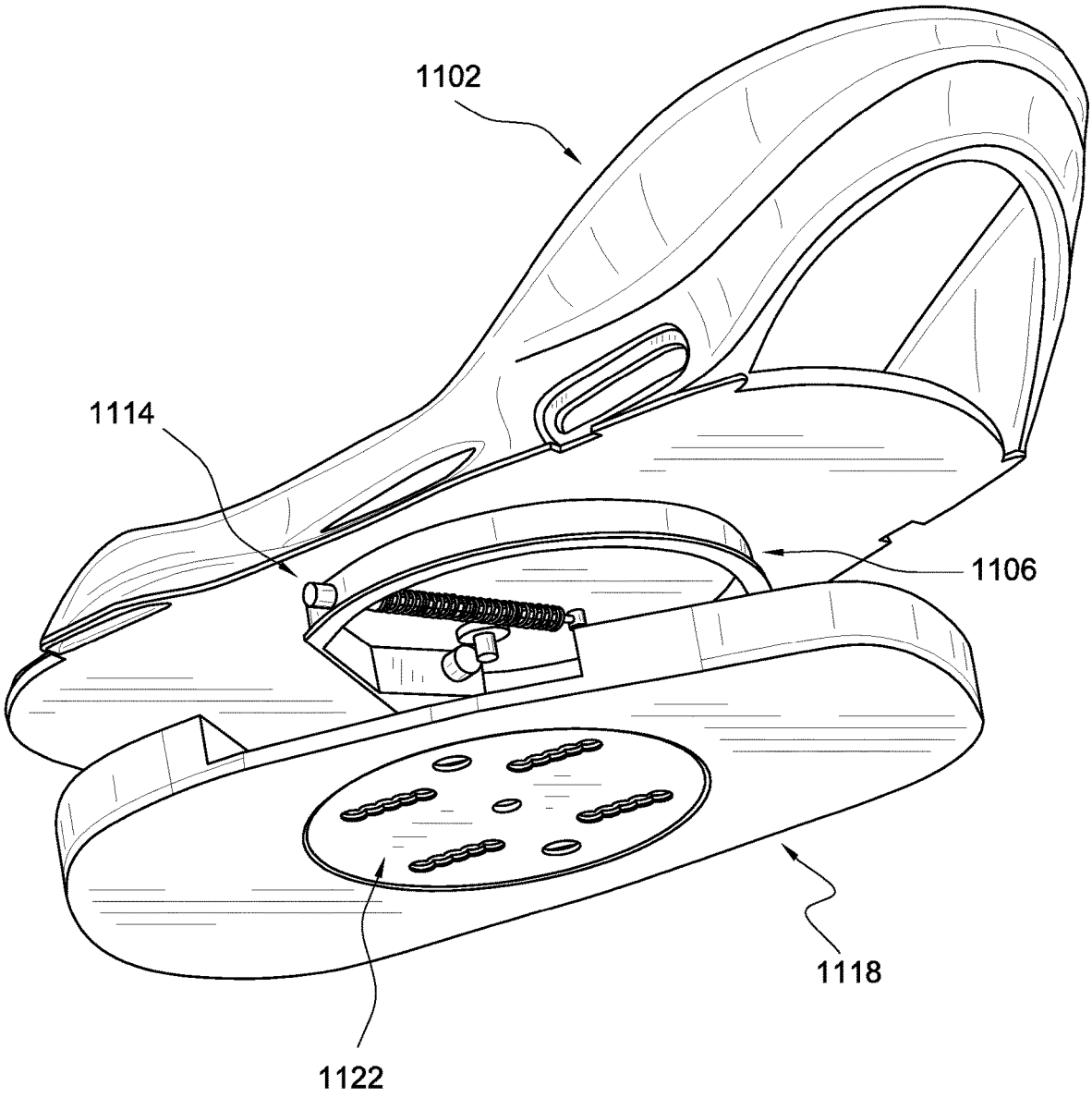
Figure 14D:
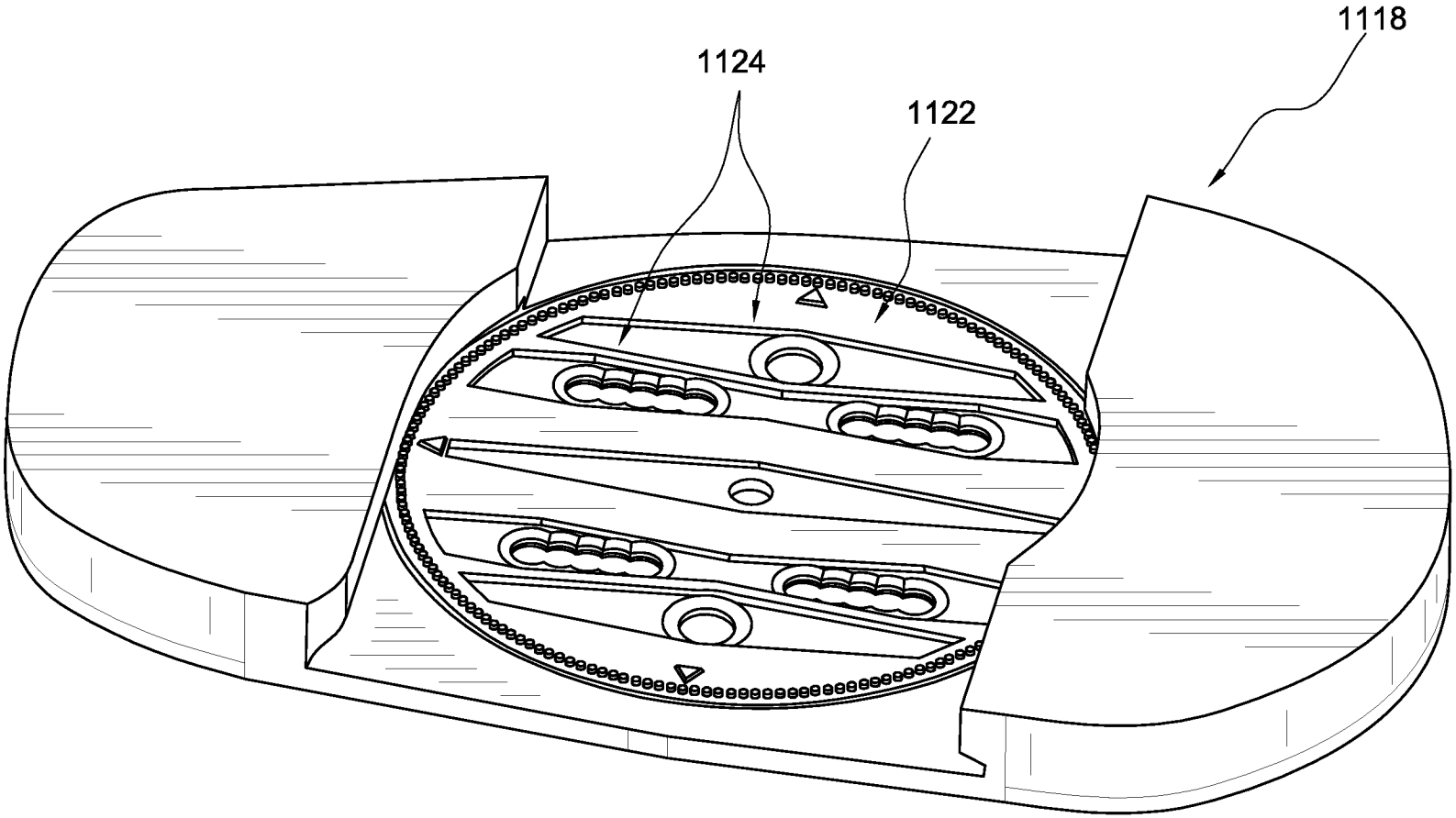
Figure 14E:
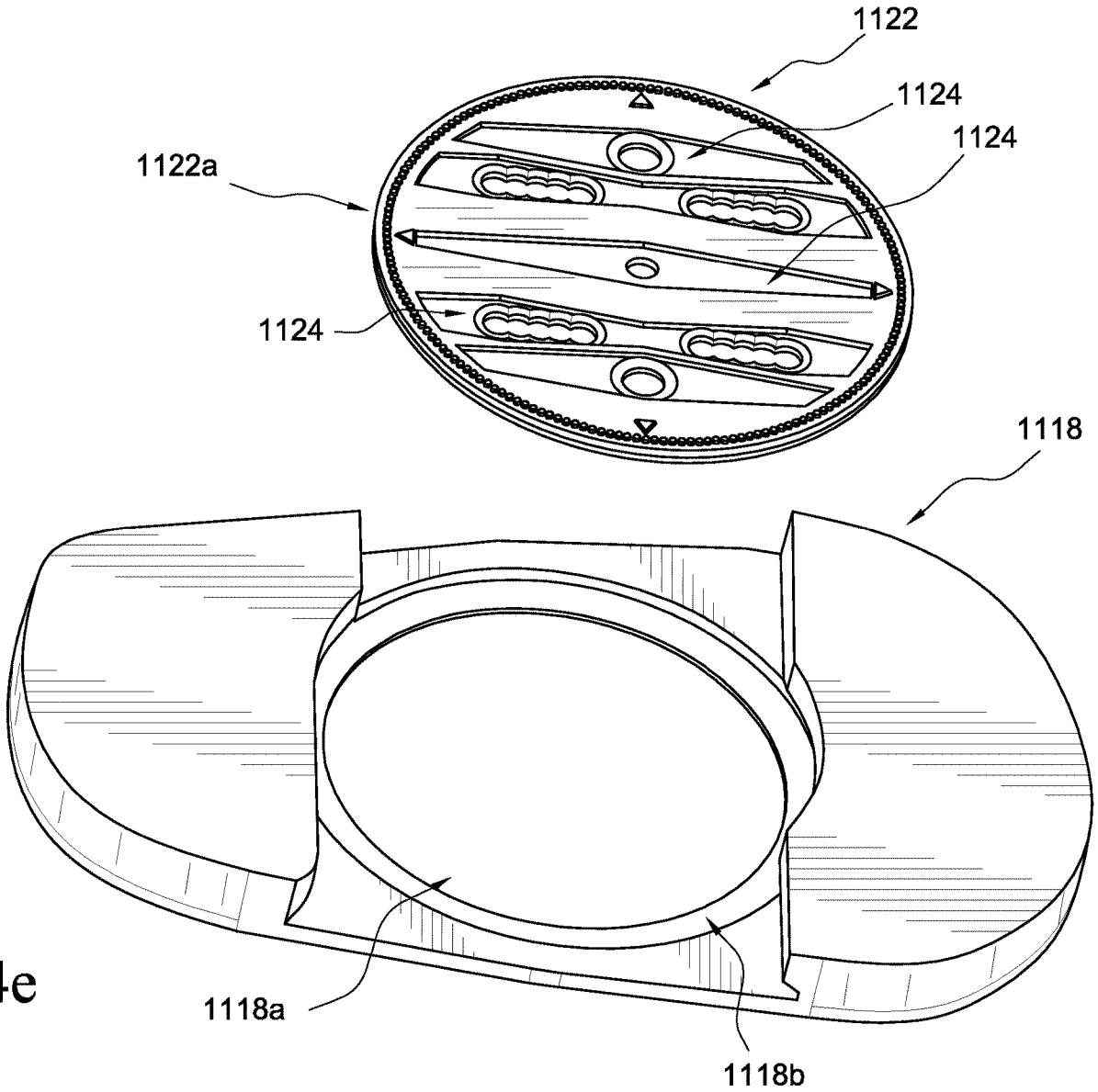

As further shown in FIGS. 14*a*-14*e*, a mounting plate 1122 may also be provided which can be permanently, or removably, connected to the baseplate 1118. In general, the mounting plate 1122 may define one or more different fastener patterns 1124, which may take the form of holes, slots, or grooves, for example, that may be used to attach the mounting plate 1122 to the snowboard (not shown) or other snow sport device. Such fasteners may take the form of bolts, screws, rivets, or any other suitable type of fastener. As best shown in FIG. 14*e*, the mounting plate 1122 may be configured to be received in an opening 1118*a* defined by the baseplate 1118 such that the outer rim 1122*a* of the mounting plate 1122 is supported by a flange 1118*b* defined by the baseplate 1118. In this way, the baseplate 1118 is securely held to the snowboard by the mounting plate 1122. In at least some embodiments, the mounting plate 1122 is interchangeable with another mounting plate having a different fastener pattern than the mounting plate 1122. In this way, the snowboard binding 1100 can be readily adapted to a wide variety of mounting configurations.

Figure 15A:
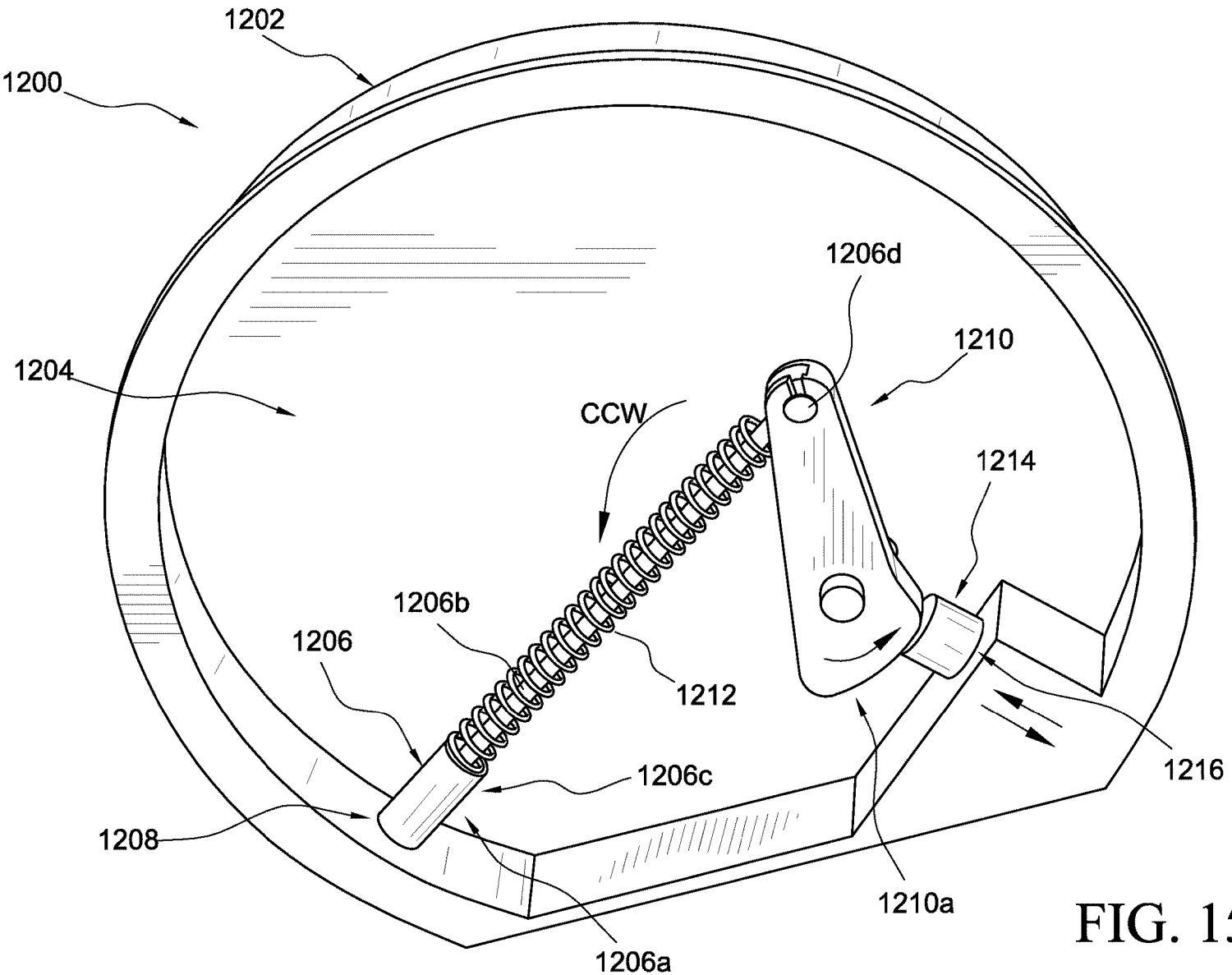
FIGS. 15*a*-15*b* are directed to another alternative embodiment of a remote release snowboard binding.
Figure 15B:
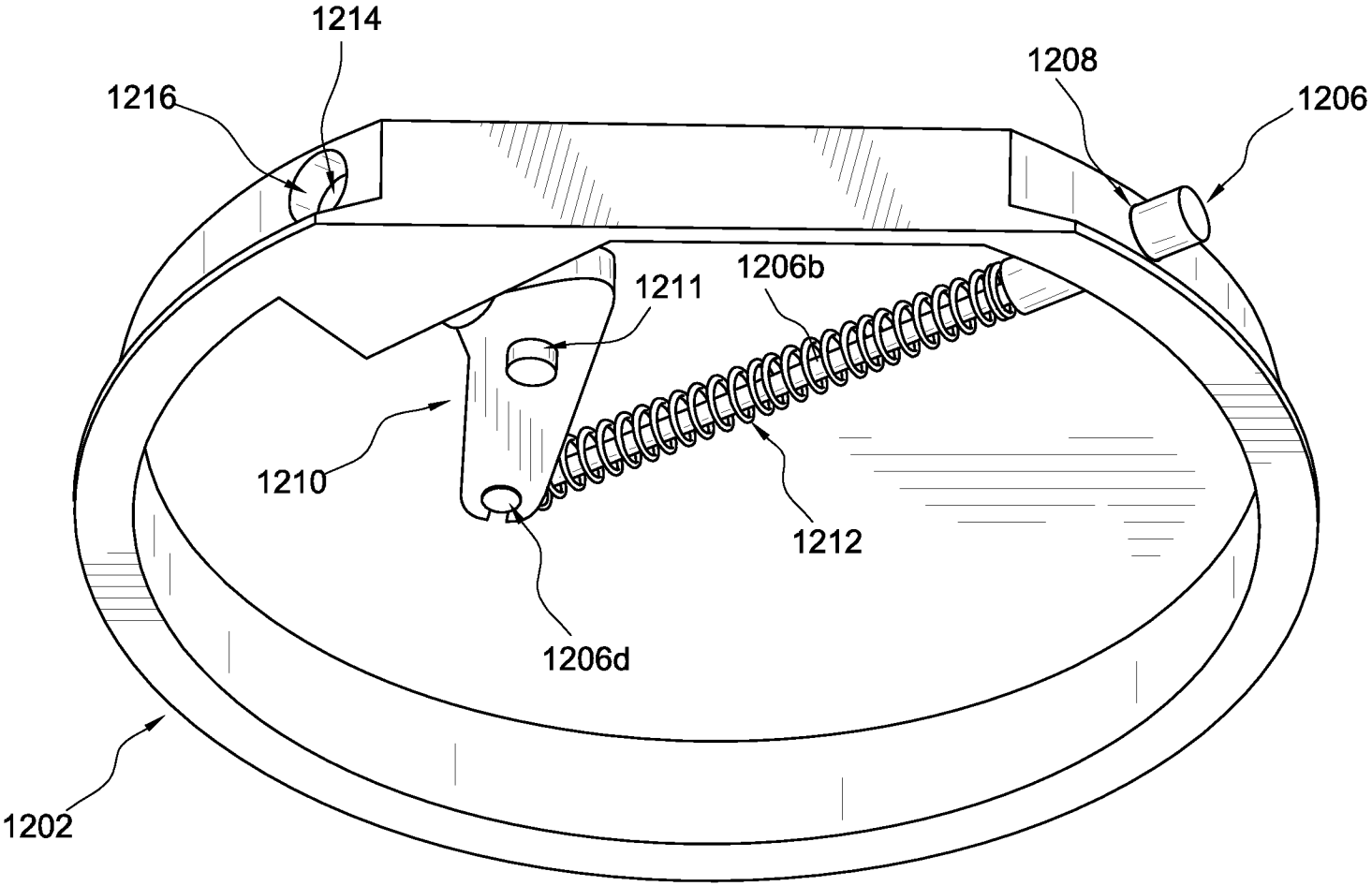

With reference finally to FIG. 15, details are provided concerning a further alternative embodiment of a snowboard binding, which is denoted generally at 1200. The snowboard binding 1200 may include a housing 1202, which may be similar, or identical, in its size and/or configuration to other housings disclosed herein. As in the case of other disclosed embodiments, the housing 1202 may be mounted to the sole of a boot interface portion (not shown). An actuator assembly 1204 may be partly, or completely, disposed in the housing 1202. The actuator assembly 1204 may be attached to a cable 1206 that enters the housing 1202 by way of a bore 1208 defined by the housing 1202. A distal portion 1206*a* of the cable 1206 may be clamped (not shown), or otherwise fixed, to the housing 1202 at a location near the bore 1208. The cable 1206 may be routed to a location, such as the back of a boot interface portion, where a handle (not shown) attached to the cable 1206 may be securely grasped by a user.

In more detail, the cable 1206 includes a movable cable element 1206*b* slidably received within a protective sheath 1206*c* and includes a terminal end 1206*d* rotatably connected to a cam 1210 which, in turn, is rotatably connected to the housing 1202 by way of a pin or shaft 1211. Thus, when a user pulls on the movable cable element 1206*b* so as to effect a release of the boot interface portion from the snowboard, the cam 1210 is caused to rotate counterclockwise as shown in FIG. 15. Because the movable cable element 1206*b* passes through a spring 1212, this counterclockwise motion of the cam 1210 overcomes the bias imposed on the cam 1210 by the spring 1212 and serves to compress the spring 1212.

As the cam 1210 rotates counterclockwise in response to a user pulling a handle attached to the cable 1206, a corresponding rotation of a cam surface 1210*a* acts on the end of a plunger 1214 that is configured and arranged for reciprocal motion in a bore 1216 defined by the housing 1202. In particular, the counterclockwise rotational motion of the cam 1210 causes the cam surface 1210*a* to drive the plunger 1214 further into the bore 1216, thus pushing a spring-loaded pin (not shown) out of the bore 1216, thereby disengaging the housing 1202 from a baseplate (not shown). As the foregoing suggests, the spring-loaded pin may be an element of, and reside at least partially in, a baseplate. Moreover, the spring-loaded pin may be biased into an extended position in which the spring-loaded pin is at least partially positioned in the bore 1216, such that the baseplate is releasably locked to the housing 1202.

When the user releases the handle (not shown) attached to the cable 1206, the spring 1212 is free to act on the cam 1210, causing the cam 1210 to rotate clockwise and thereby allow the pin 1214 to move back toward the interior of the housing 1202. This movement of the pin 1214 correspondingly allows the spring-loaded pin to once again extend from the housing 1202. To reenter the snowboard binding 1200, the user does not need to pull the handle attached to the cable 1206. Rather, the user can simply reenter the snowboard binding 1200 in the same manner as described herein with respect to other embodiments of the invention. When the user does so, the spring-loaded pin (not shown) enters the bore 1216, thus locking the housing 1202 to the baseplate.

J. Example Computing Devices and Associated Media

The embodiments disclosed herein may include the use of a special purpose or general-purpose computer including various computer hardware or software modules, as discussed in greater detail below. A computer may include a processor and computer storage media carrying instructions that, when executed by the processor and/or caused to be executed by the processor, perform any one or more of the methods disclosed herein. In some embodiments, such a computer can take the form of a smartphone or other mobile communication device.

As indicated above, embodiments within the scope of the present invention also include computer storage media, which are physical media for carrying or having computer-executable instructions or data structures stored thereon. Such computer storage media can be any available physical media that can be accessed by a general purpose or special purpose computer.

By way of example, and not limitation, such computer storage media can comprise hardware such as solid state disk (SSD), RAM, ROM, EEPROM, CD-ROM, flash memory, phase-change memory ("PCM"), or other optical disk storage, magnetic disk storage or other magnetic storage devices, or any other hardware storage devices which can be used to store program code in the form of computer-executable instructions or data structures, which can be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' can refer to software objects or routines that execute on the computing system. The different components, modules, engines, and services described herein may be implemented as objects or processes that execute on the computing system, for example, as separate threads. While the system and methods described herein can be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention can be performed in client-server environments, whether network or local environments, or in any other suitable environment. Suitable operating environments for at least some embodiments of the invention include cloud computing environments where one or more of a client, server, or target virtual machine may reside and operate in a cloud environment.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A snowboard binding, comprising:

a retention and release assembly configured to be mounted to a snowboard, and including a retention mechanism operable by a wireless remote control; and a boot interface portion configured to releasably engage the retention and release assembly, and the boot interface portion further configured to releasably retain a boot, and when the boot interface portion is fully engaged with the retention and release assembly, the boot interface portion is rotatable relative to the retention and release assembly.

2. The snowboard binding as recited in claim 1, wherein the retention and release assembly is configured to be mounted to a channel mount system of a snowboard.

3. The snowboard binding as recited in claim 1, wherein when the boot interface portion is fully engaged with the retention and release assembly, the boot interface portion is rotatable between (i) a locked position in which the boot interface portion is locked to the retention and release assembly and (ii) an unlocked position in which the boot interface portion is unlocked from the retention and release assembly.

4. The snowboard binding as recited in claim 1, wherein the boot interface portion is lockable to the retention and release assembly by the retention mechanism such that the boot interface portion is prevented from rotational motion or translational motion relative to the retention and release assembly, and operation of the remote control causes the retention mechanism to unlock the boot interface portion from the retention and release assembly.

5. The snowboard binding as recited in claim 3, wherein one of the retention and release assembly and the boot interface portion comprises a pin that is configured to be removably received in a bore defined by the other of the retention and release assembly and the boot interface portion, and the pin is positioned in the bore when the boot interface portion is in the locked position, and the pin is in a retracted state with respect to the bore when the boot interface portion is in the unlocked position.

6. The snowboard binding as recited in claim 5, wherein the pin is biased by a resilient element that automatically extends the pin into the bore as the boot interface portion is rotated from the unlocked position to the locked position.

7. The snowboard binding as recited in claim 5, wherein movement of the pin is opposable by a plunger that resides in the bore, and the plunger is responsive to a signal transmitted by the wireless remote control.

8. The snowboard binding as recited in claim 1, wherein the retention and release assembly includes a baseplate having two slots that enable the baseplate to be placed in a desired orientation on the snowboard when the retention and release assembly is mounted to the snowboard.

9. The snowboard binding as recited in claim 1, wherein the boot interface portion is configured for both rotational motion and translational motion relative to the retention and release assembly when the boot interface portion is fully engaged with the retention and release assembly.

10. A kit, comprising:

the snowboard binding as recited in claim 1; and a wireless remote control device operable by a user to cause the retention mechanism to unlock the boot interface portion from the retention and release assembly.

11. An apparatus, comprising:

a snow sport device; and a binding, comprising:

a retention and release assembly configured to be mounted to the snow sport device, and including a retention mechanism operable by a wireless remote control; and a boot interface portion configured to releasably engage the retention and release assembly, and the boot interface portion further configured to releasably retain a boot, and when the boot interface portion is fully engaged with the retention and release assembly, the boot interface portion is rotatable relative to the retention and release assembly.

12. The apparatus as recited in claim 11, wherein the snow sport device comprises a snowboard.

13. The apparatus as recited in claim 12, wherein the snowboard has a split board construction.

14. The apparatus as recited in claim 11, wherein the snow sport device is a snowboard that includes a channel mount system, and the retention and release assembly is configured to connect to the channel mount system.

15. The apparatus as recited in claim 11, wherein the boot interface portion is configured for both rotational motion and translational motion relative to the retention and release assembly.

16. The apparatus as recited in claim 11, wherein one of the retention and release assembly and boot interface portion comprises a pin that is configured to be removably received in a bore defined by the other of the retention and release assembly and boot interface portion.

17. The apparatus as recited in claim 16, wherein movement of the pin is opposable by a plunger that resides in the bore, and the plunger is responsive to a signal transmitted by the wireless remote control.

18. The apparatus as recited in claim 11, wherein the retention mechanism unlocks the boot interface portion from the retention and release assembly in response to a signal from a wireless remote control.

19. The apparatus as recited in claim 11, further comprising an additional binding mounted to the snow sport device.

20. An apparatus comprising:

a snow sport device; and a binding, comprising:

a retention and release assembly configured to be mounted to the snow sport device, and including a retention mechanism operable by a wireless remote control, wherein the retention mechanism is substantially disposed within a housing of the retention and release assembly and comprises:

a power source;

a motor connected to the power source;

a plunger connected to the motor;

a limit switch actuator carried by the plunger;

a limit switch configured to engage the limit switch actuator; and control circuitry connected to the motor, power source, and limit switch, and configured for wireless communication with the wireless remote control; and a boot interface portion configured to releasably engage the retention and release assembly, and the boot interface portion further configured to releasably retain a boot.

21. An apparatus, comprising:

a manually operable retention and release assembly configured to be mounted to a snow sport device; and a boot interface portion configured to releasably engage the retention and release assembly, and the boot interface portion further configured to releasably retain a boot, and when the boot interface portion is fully engaged with the retention and release assembly, the boot interface portion is rotatable relative to the retention and release assembly, wherein one of the manually operable retention and release assembly and the boot interface portion includes a pin configured to be removably received within a bore defined by the other of the manually operable retention and release assembly and the boot interface portion.

22. The apparatus as recited in claim 21, further comprising a cable connected at least indirectly to the pin.

23. The apparatus as recited in claim 21, further comprising a spring which acts to bias the pin in a particular direction.

24. The apparatus as recited in claim 21, wherein the pin is configured to be either pushed out of the bore, or retracted from the bore.

25. The apparatus as recited in claim 21, wherein the manually operable retention and release assembly is also configured to be actuated by a wireless remote control.

26. The apparatus as recited in claim 21, further comprising a snow sport device to which the manually operable retention and release assembly is mounted.

* * * * *